US010971086B2

(12) United States Patent
Le et al.

(10) Patent No.: US 10,971,086 B2
(45) Date of Patent: Apr. 6, 2021

(54) PULSED BACKLIGHT SYSTEMS AND METHODS

(71) Applicant: Apple Inc., Cupertino, CA (US)

(72) Inventors: Chengrui Le, San Jose, CA (US); Chaohao Wang, Sunnyvale, CA (US); Li Tao, Stanford, CA (US); Lingyu Hong, Princeton Jct, NJ (US); Paolo Sacchetto, Cupertino, CA (US); Sheng Zhang, Milpitas, CA (US); Xiaokai Li, Sunnyvale, CA (US); Yingying Tang, Sunnyvale, CA (US); Yunhui Hou, San Jose, CA (US); Johan L. Piper, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/265,902

(22) Filed: Feb. 1, 2019

(65) Prior Publication Data

US 2019/0244572 A1 Aug. 8, 2019

Related U.S. Application Data

(60) Provisional application No. 62/625,910, filed on Feb. 2, 2018.

(51) Int. Cl.
*G09G 3/34* (2006.01)
*G09G 3/36* (2006.01)

(52) U.S. Cl.
CPC ..... *G09G 3/3406* (2013.01); *G09G 3/342* (2013.01); *G09G 3/36* (2013.01); *G09G 2320/0247* (2013.01); *G09G 2320/0261* (2013.01); *G09G 2320/041* (2013.01); *G09G 2320/062* (2013.01); *G09G 2320/064* (2013.01); *G09G 2320/0606* (2013.01); *G09G 2320/0633* (2013.01); *G09G 2320/0646* (2013.01); *G09G 2320/103* (2013.01); *G09G 2340/0435* (2013.01); *G09G 2354/00* (2013.01); *G09G 2360/16* (2013.01)

(58) Field of Classification Search
CPC ..... G09G 3/3406; G09G 3/342; G09G 3/36
See application file for complete search history.

(56) References Cited

U.S. PATENT DOCUMENTS 8,217,889 B2 7/2012 Barnhoefer et al.
8,502,768 B2 8/2013 Barnhoefer et al.
(Continued)

OTHER PUBLICATIONS

International Search Report and Written Opinion issued in PCT Application No. PCT/US2019/016399, dated Apr. 12, 2019 in 13 pages.

(Continued)

*Primary Examiner* — Alexander Eisen
*Assistant Examiner* — Cory A Almeida
(74) *Attorney, Agent, or Firm* — Kilpatrick Townsend & Stockton LLP

(57) ABSTRACT

Aspects of the subject technology relate to pulsed backlight operation for a display backlight. Backlight pulse patterns are provided that include steady state pulse patterns to be applied during operation of a liquid crystal display unit of the display at a corresponding frame rate. The backlight pulse patterns can be arranged to prevent visible artifacts such as flicker or strobing, particularly at or near a transition between LCD frame rates. In some scenarios, transition pulse patterns are provided.

15 Claims, 24 Drawing Sheets

(56) References Cited

U.S. PATENT DOCUMENTS

| | | | | |
|---|---|---|---|---|
| 2007/0262733 | A1* | 11/2007 | Lin | G09G 3/3406 315/312 |
| 2009/0073343 | A1* | 3/2009 | Kojima | G09G 3/3406 349/61 |
| 2013/0141479 | A1* | 6/2013 | Choi | G09G 3/3406 345/691 |
| 2014/0184485 | A1* | 7/2014 | Kim | G09G 3/3406 345/102 |

OTHER PUBLICATIONS

International Search Report and Written Opinion issued in PCT Application No. PCT/US2019/016399, dated Aug. 13, 2020 in 11 pages.

* cited by examiner

PULSED BACKLIGHT SYSTEMS AND METHODS

CROSS-REFERENCE TO RELATED APPLICATIONS

This application claims the benefit of priority under 35 U.S.C. § 119(e) of U.S. Provisional Patent Application No. 62/625,910, entitled "Pulsed Backlight Systems and Methods," filed on Feb. 2, 2018, which is hereby incorporated by reference in its entirety.

TECHNICAL FIELD

The present description relates generally to electronic devices with displays, and more particularly, but not exclusively, to electronic devices with displays having backlights.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Liquid crystal displays commonly include a backlight unit and a liquid crystal display unit with individually controllable liquid crystal display pixels.

The backlight unit commonly includes one or more light-emitting diodes (LEDs) that generate light that exits the backlight toward the liquid crystal display unit. The liquid crystal display pixels are individually operable to control passage of light from the backlight unit through that pixel to display content such as text, images, video, or other content on the display.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
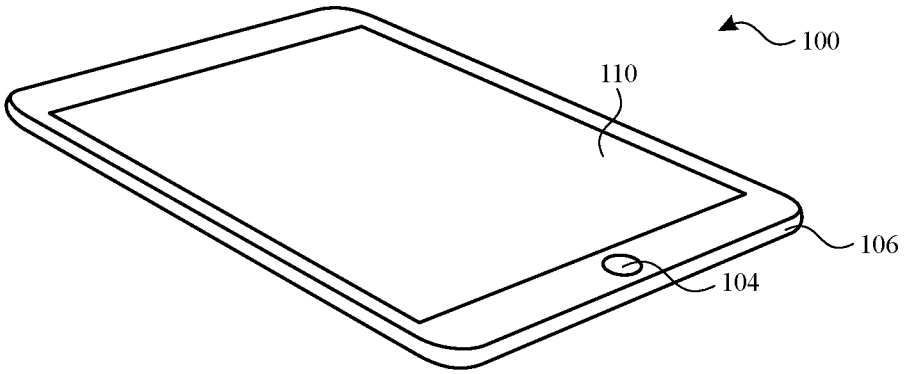
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, tablet computers, laptop computers, set-top boxes, smart watches, wireless access points, and other electronic equipment that include light-emitting diode arrays such as in backlight units of displays. Displays are used to present visual information and status data and/or may be used to gather user input data. A display includes an array of display pixels. Each display pixel may include one or more colored subpixels for displaying color images. The display pixels may be formed from light-emitting diodes (LEDs), organic light-emitting diodes (OLEDs), plasma cells, electrophoretic display elements, electrowetting display elements, liquid crystal display (LCD) components, or other suitable display pixel structures.

In the example of an LCD display, each display pixel includes a layer of liquid crystals disposed between a pair of electrodes operable to control the orientation of the liquid crystals. Controlling the orientation of the liquid crystals controls the polarization of backlight from a backlight unit of the display. This polarization control, in combination with polarizers on opposing sides of the liquid crystal layer, allows light passing into the pixel to be manipulated to selectively block the light or allow the light to pass through the pixel.

The backlight unit includes one or more light-emitting diodes (LEDs) such as one or more strings and/or arrays of light-emitting diodes that generate the backlight for the display. In various configurations, strings of light-emitting diodes may be arranged along one or more edges of a light guide plate that distributes backlight generated by the strings to the LCD unit, or may be arranged to form a two-dimensional array of LEDs.

Conventional display backlights continuously illuminate the backlight such that light emitted by the display is only controlled by the operation of the LCD unit. In some displays, local dimming of the backlight can enhance the quality of the display by, for example, providing darker dark portions of the display and enhancing contrast between light and dark portions of a displayed image. In some circumstances, the backlight may be pulsed to further provide high resolution imaging and reduce motion blur. However, various challenges can arise when pulsing light-emitting elements of a display in cooperation with providing display frames at various frame rates (e.g., when operating a pulsed backlight in cooperation with an LCD unit operating at various frame rates). In particular, undesirable strobing effects and/or flicker effects can occur, such as when displaying moving content and/or when transitioning between various frame rates for the display content (e.g., various frame rates for operating the LCD unit).

Disclosed herein are various systems and methods for mitigating these undesirable effects, particularly at or near transitions between frame rates. As described in further detail below, these solutions include (i) generating frame-rate specific pulse patterns for a single frame frame-rate transition, (ii) modifying the pulse pattern during a transition period, (iii) removing, splitting, and/or replacing one or more pulses at or near the transition, and/or (iv) providing a decision engine for determining when and how to pulse the backlight.

An illustrative electronic device having a display with a backlight is shown in FIG. 1. In the example of FIG. 1, device 100 has been implemented using a housing that is sufficiently small to be portable and carried by a user device 100 of FIG. 1 may be a handheld electronic device such as a tablet computer or a cellular telephone). As shown in FIG.

1, device 100 may include a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 may include display pixels formed from light-emitting diodes (LEDs), organic light-emitting diodes (OLEDs), plasma cells, electrophoretic display elements, electrowetting, display elements, liquid crystal display (LCD) components, or other suitable display pixel structures. Arrangements in which display 110 is formed using LCD pixels and LED backlights are sometimes described herein as an example. This is, however, merely illustrative. In various implementations, any suitable type of display technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations.

In some implementations, electronic device 100 may be provided in the form of a computer integrated into a computer monitor. Display 110 may be mounted on a front surface of housing 106 and a stand may be provided to support housing (e.g., on a desktop).

Figure 2:
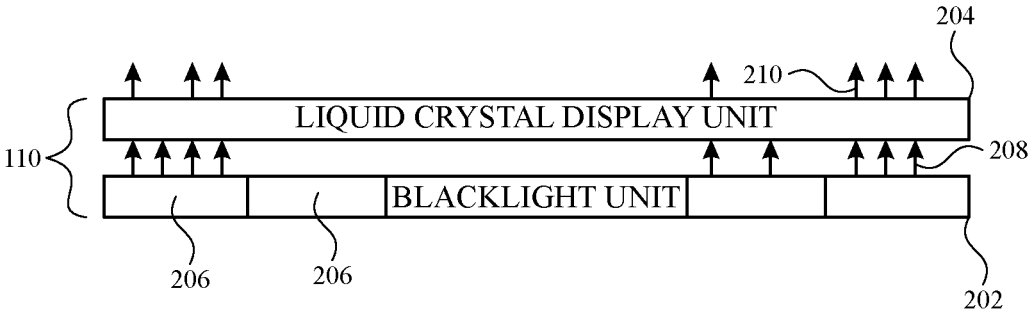
FIG. 2 illustrates a block diagram of a side view of an electronic device display having a backlight unit in accordance with various aspects of the subject technology.

FIG. 2 is a schematic diagram of display 110 in which the display is provided with a liquid crystal display unit 204 and a backlight unit (BLU) 202. As shown in FIG. 2, backlight unit 202 generates backlight 208 and emits backlight 208 in the direction of liquid crystal display unit 204. Liquid crystal display unit 204 selectively allows some or all of the backlight 208 to pass through the liquid crystal display pixels therein to generate display light 210 visible to a user. Backlight unit 202 includes one or more subsections 206.

In some implementations, subsections 206 may be elongated subsections that extend horizontally or vertically across some or all of display 110 (e.g., in an edge-lit configuration for backlight unit 202). In other implementations, subsections 206 may be square, other rectilinear, or otherwise shaped subsections (e.g., subarrays of a two-dimensional LED array backlight). Accordingly, subsections 206 may be defined by one or more strings and/or arrays of LEDs disposed in that subsection. Subsections 206 may be controlled individually for local dimming of backlight 208.

Figure 3:
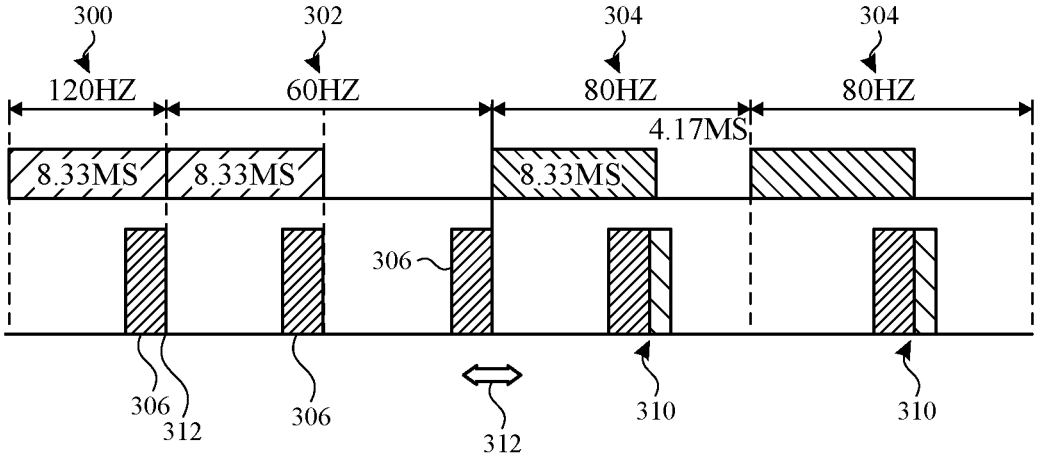
FIG. 3 illustrates a timing diagram illustrating backlight pulses associated with display frame rate changes in accordance with various aspects of the subject technology.

FIG. 3 shows an example timeline of backlight pulses for each of several LCD frames. In the example of FIG. 3, a single backlight pulse 306 is provided in a first frame 300 of the LCD (e.g., a 120 Hz frame), two backlight pulses 306 having the same width as the pulse for the first frame 300 are provided in a second frame 302 that is twice as long as the first frame (e.g., a 60 Hz frame). However, in order to ensure that the average brightness of the display does not change, when an intermediate length frame 304 (e.g., an 80 Hz frame) occurs, backlight pulses 310 are provided with an increased width relative to the width of pulses 306.

Figure 4:
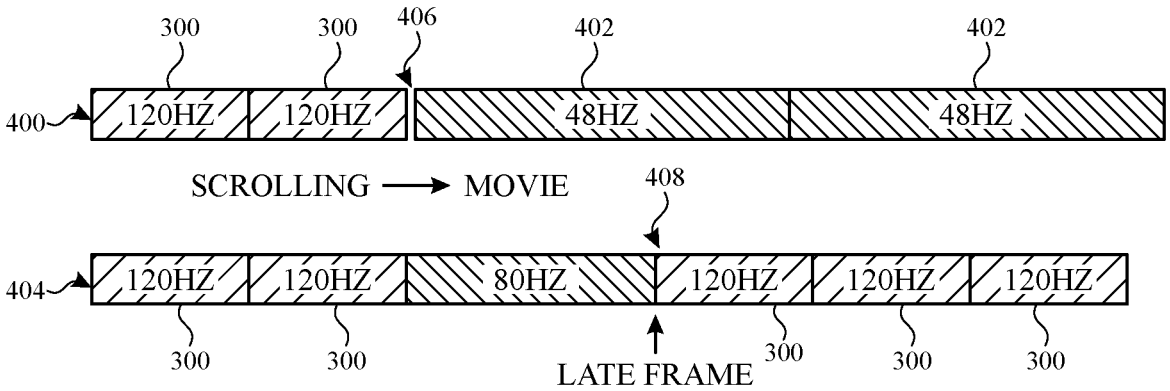
FIG. 4 illustrates timing diagrams with frame rate transitions at which artifacts can occur in accordance with various aspects of the subject technology.

Although the pulses 306 and 310 of FIG. 3 can maintain the average brightness of the display and reduce motion blur, other visible artifacts such as strobing or flicker at the transitions 312 between frames of different length can occur. FIG. 4 shows two example display timelines 400 and 404 that include frame rate transitions for the LCD using that could cause flicker if pulses of the type shown in FIG. 3 are used without any other considerations. As one example, timeline 400 includes a transition 406 from 120 Hz frames 300 to 48 Hz frames 402 that may occur when the display transitions from displaying scrolling content to displaying movie content. As another example, timeline 404 includes a transition 408 such as a late frame transition that can occur when an 80 Hz frame 304 is displayed between two 120 Hz frames 300. However, it should be appreciated that the example timelines of FIG. 4 are merely illustrative and other transitions can occur that may cause visible artifacts if care is not taken.

In accordance with some aspects of the subject disclosure, the pulsing pattern within each LCD frame, including the number of pulses within a frame, the width of each pulse, and the location of the center of each pulse can be tuned and adjusted to minimize or eliminate visible flicker. The flicker resulting from backlight pulses across a transition can be modeled as a weighted sum of frequency components of the pulses, in which every pulse contributes into all frequency components and in which the weights correspond to a human eye temporal sensitivity at that frequency. Using this flicker model, the pulsing pattern can be tuned to prevent flicker associated with a frame rate transition.

Figure 5:
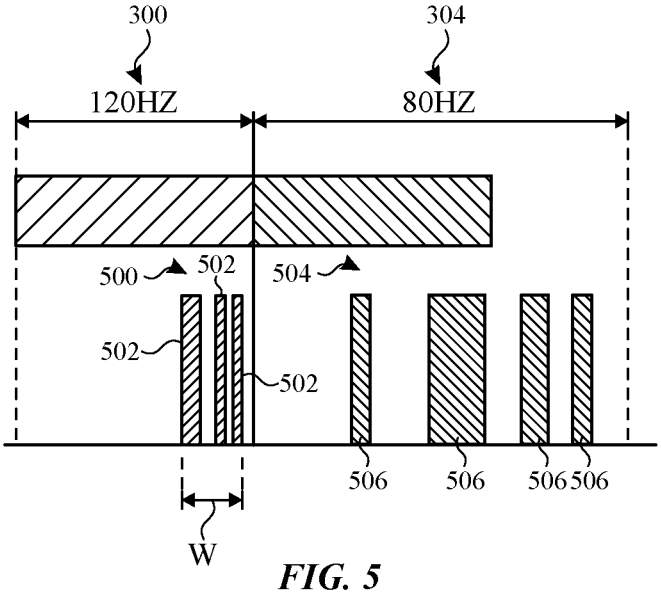
FIG. 5 illustrates backlight pulse patterns for reduced flicker at a frame rate transition in accordance with various aspects of the subject technology.

FIG. 5 shows one example of a set of backlight pulse patterns that can be applied to reduce or eliminate flicker associated with a frame rate transition for an LCD. In the example of FIG. 5, backlight pulse pattern 500 is applied during a 120 Hz LCD frame and backlight pulse pattern 504 is applied for a subsequent 80 Hz LCD frame to reduce or eliminate visible flicker at the LCD transition from the 120 Hz frame to the 80 Hz frame.

In the example of FIG. 5, pulse pattern 500 has an overall width W that is contained within the second half of the frame and that includes three pulses 502 with individual pulse widths. Pulse pattern 504 includes four pulses 506 distributed throughout the 80 Hz frame and each having an individual pulse width. Pulse patterns 500 and 504 are determined by identifying the flicker caused by test patterns for patterns 500 and 504 using the model above, and varying the test patterns to find pattern pairs for which (1) flicker due to transitions or alternating between 120 Hz and 80 Hz frames is eliminated, (2) flicker within a single 80 Hz frame is minimized, and/or (3) the overall width W of the 120 Hz pulse pattern in weighted toward smaller widths. Each of conditions (1), (2), and (3) can be included or not during the varying of the test patterns until the desired patterns 500 and 504 are identified. Test pulse patterns for pulse patterns 500 and 504 on both sides of the transition can be varied together (e.g., alternating or simultaneous variations) to take into account both sides of the transition at the same time. It should be appreciated that, although a 120 Hz to 80 Hz transition is illustrated. in FIG. 5, similar pulse patterns can be identified for any frame rate transition (e.g., 120 Hz to 60 Hz, 60 Hz to 120 Hz, 240 Hz to 120 Hz, 240 Hz to 80 Hz, 80 Hz to 120 Hz, 80 Hz, to 240 Hz, or other LCD frame rate transitions). Pulse patterns such as pulse patterns 500 and 504 can be steady state patterns that are used for all frames that are provided by the display at the corresponding frame rate, or can be temporary patterns that are applied only during frames adjacent to the transition.

Pulse patterns (e.g., patterns defined by the overall width, overall location, individual pulse location, individual pulse width, and number of pulses per frame) such as pulse patterns 500 and 504 can be further tuned to account for other display effects. For example, the number of pulses in a pulse pattern can be reduced to reduce or minimize a multiple image effect while maintaining a sufficient number of pulses within each frame to complete a flicker free transition in a single frame.

As another example, the location, number, and width of the pulses in the pulse patterns can be further tuned for compatibility with passive driving of the backlight (e.g., to avoid overlapping pulses in different rows operated by the same driver). In this way, the pulse patterns can be tuned for the number of display drivers (e.g., two or four drivers) and/or to reduce the number of drivers. As another example, the location, number, and width of the pulses in the pulse patterns can be further tuned to account for the settling time of liquid crystal components in liquid crystal display unit 204. For compatibility with the settling time of liquid crystal display unit 204, certain conditions on the entry and exit of a strobing mode for BLU 202 can be applied using a decision engine in the display), as will be discussed in further detail hereinafter.

Figure 6:
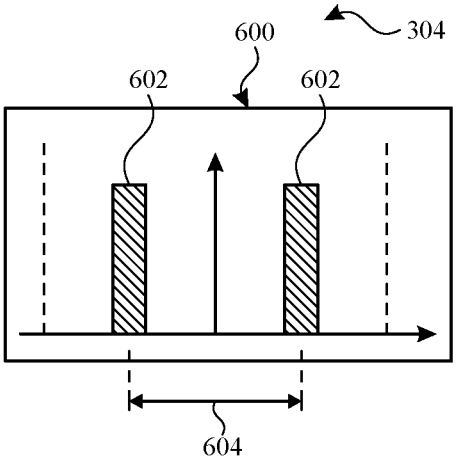
FIG. 6 illustrates another backlight pulse educed flicker in accordance with various aspects of the subject technology.
Figure 7:
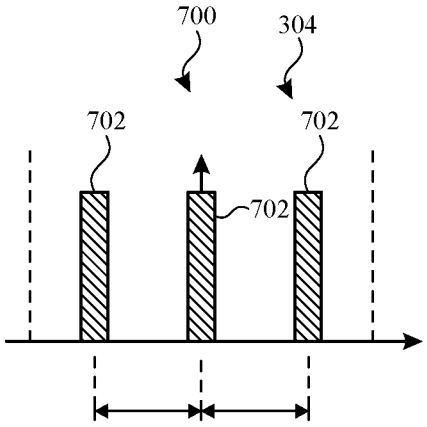
FIG. 7 illustrates another backlight pulse pattern for reduced flicker in accordance with various aspects of the subject technology.
Figure 8:
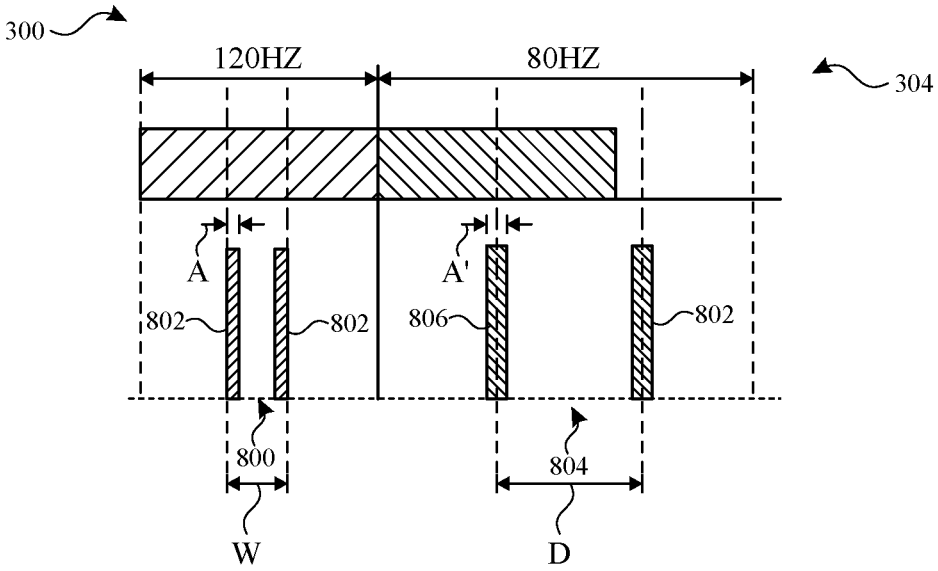
FIG. 8 illustrates two-pulse backlight pulse patterns for reduced flicker at a frame rate transition in accordance with various aspects of the subject technology.

FIGS. 6 and 7 respectively show two-pulse and three-pulse pulse pattern examples that can be used for the 80 Hz frame 300 to reduce or eliminate visible artifacts as described above at the frame rate transition. In the example of FIG. 6, pulse pattern 600 includes two pulses 602 separated by a separation time 604 equal to one half of the frame time and equidistant from the center of the frame. In the example of FIG. 7, pulse pattern 700 include three pulses 702 separated from each other by a common separation time 704 equal to one third of the frame time. FIG. 8 shows an example in which a two-pulse pattern 800 having two pulses 802 equidistant from the center of the frame are applied during a 120 Hz frame 300 and a two-pulse pattern 804 having two pulses 806 equidistant from the center of the frame are applied during the subsequent 80 Hz frame 304. However, pulses 806 have an individual pulse width A' that is wider than the pulse width A of pulses 802 and pulses 806 are separated by a separation time D that is larger than the overall width W of pulses 802.

Example pulse patterns shown in FIGS. 5-8 can be steady state pulse patterns that are used for a single frame transition between frame rates (e.g., in which the pulse pattern applied during the first frame after the frame rate transition is the same as the pulse pattern applied for all subsequent frames at the same frame rate, and the pulse pattern applied for the last frame before the frame rate transition is the same as the pulse pattern applied for all prior frames at that same frame rate, without a specific, intervening transition pattern).

However, alternatively or in addition, a separate transition pulse pattern can be applied between operating the backlight with a first pulse pattern for a first LCD frame rate and with a second pulse pattern for a second LCD frame rate, to prevent visible artifacts such as flicker and/or flashing or strobing.

Figure 9:
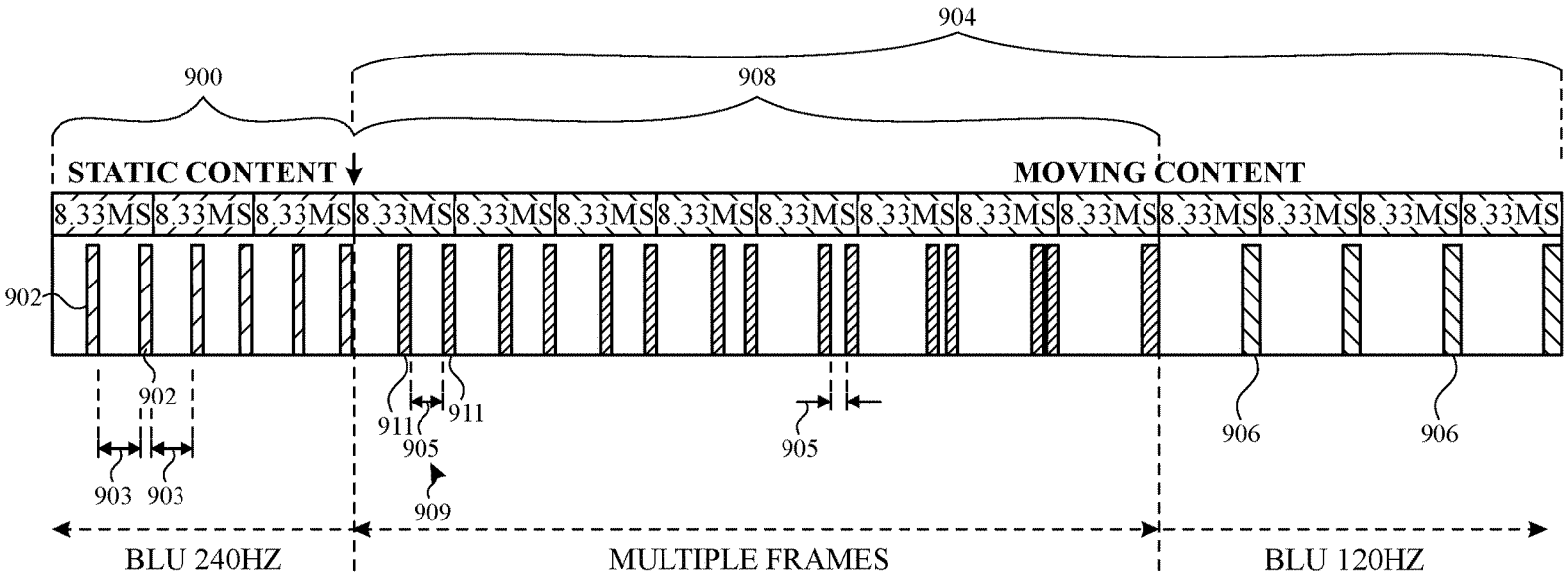
FIG. 9 illustrates a transition pulse pattern for a display backlight in accordance with various aspects of the subject technology.
Figure 10:
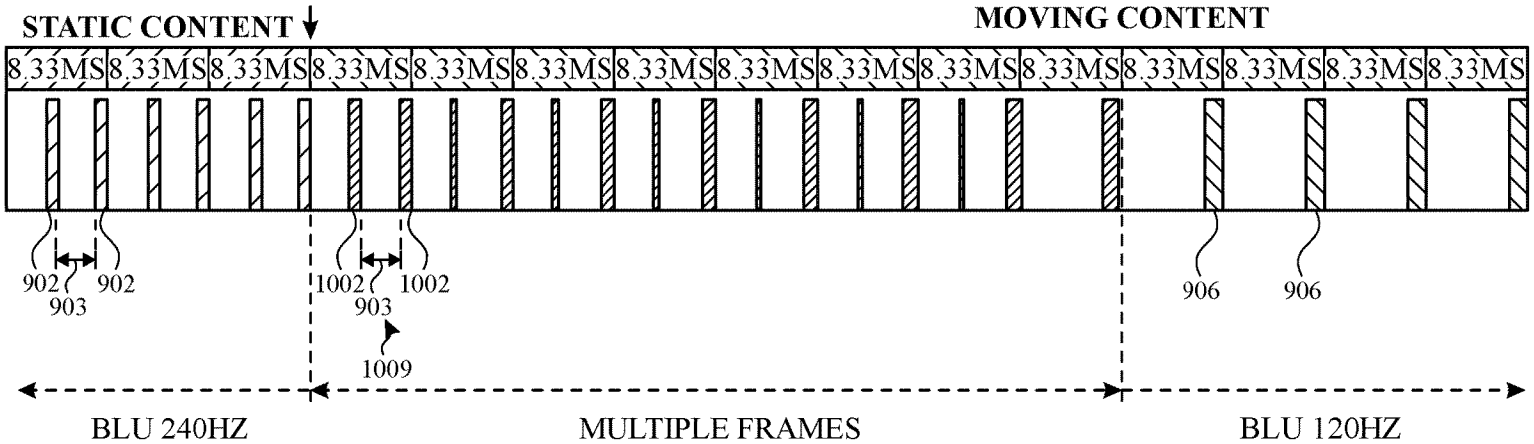
FIG. 10 illustrates another transition pulse pattern for a display backlight in accordance with various aspects of the subject technology.

FIGS. 9 and 10 each show an example of a transition pattern that can be applied between operating the backlight with a first pulse pattern for a first LCD frame rate and with a second pulse pattern for a second LCD frame rate. As shown in FIG. 9, during a time period 900 while static display content is displayed by LCD unit 204, backlight unit 202 provides backlight pulses 902 in a first steady-state pulse pattern (e.g., with a frequency of 240 Hz and spaced apart by a separation time 903). At transition time 907, the static displayed content is replaced with moving display content by LCD unit 204 during a time period 904. Responsive to the change in frame rate of the LCD, BLU 202 eventually begins providing backlight pulses 906 in a second steady-state backlight pulse pattern (e.g., with pulses 906 that are twice as wide and half as frequent as the 240 Hz pulses 902).

However, in order to avoid visible artifacts caused by the transition from the first backlight pulse pattern to the second backlight pulse pattern, BLU 202 may provide a transition pulse pattern 909 during a transition time period 908. In the example of FIG. 9, the transition time period 908 is entirely within the moving content time period 904 (e.g., while LCD unit 204 is providing the moving display content with the second frame rate) and begins at the first frame of the moving content time period 904.

In the example of FIG. 9, transition pulse pattern 909 include pairs of pulses 911, each having an individual pulse width that is the same as the pulse width of pulses 902, and that are a separated by a decreasing separation time 905. Decreasing separation time 905 decreases until the two pulses of pattern 909 merge to form a single pulse of double the length, corresponding to the second pulse pattern for the moving display content. In this way, the transition pulse pattern changes over time throughout the transition time period from a pulse pattern matching the first steady state pattern to a pulse pattern matching the second steady state pattern.

However, the transition pulse pattern of FIG. 9 is merely illustrative and other transition pulse patterns are contemplated. For example, FIG. 10 shows another evolving transition pulse pattern 1009 that can be applied during transition pulse period 908. As shown, transition pulse pattern 1009 includes pairs of pulses 1000 and 1002 that are separated by a constant separation time 903. However, during transition time period 908, the width of the first pulse 1000 of pattern 1009 is reduced and the width of the second pulse 1002 of pattern 1009 is correspondingly increased until pulse 1000 is eliminated and pulse 1002 has a width corresponding to the width of pulses 906. It should be appreciated that other transition pulse patterns (e.g., a combination of patterns 909 and 1009 in which the widths and separations are both changed over time through the transition time period or patterns in which more than two pulses are applied) are also contemplated. In the examples of FIGS. 9 and 10, an eight frame transition is shown. However, transitions of other lengths can also be applied.

Figure 11:
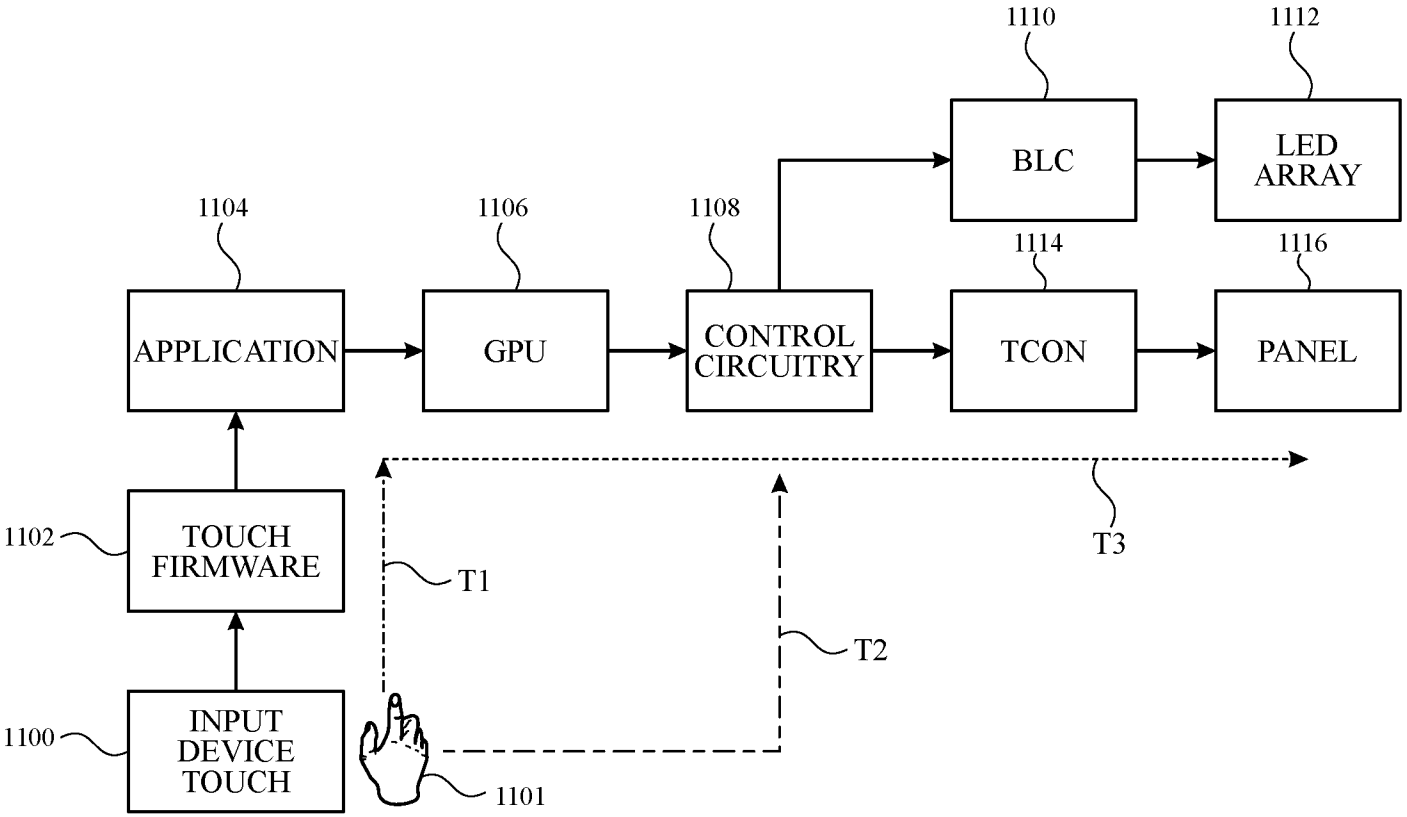
FIG. 11 illustrates display components that can provide a notification of an upcoming frame rate transition at a future time in accordance with various aspects of the subject technology.

FIG. 11 shows a schematic block diagram of components that may be included in device 100. In particular, FIG. 11 shows example components that may be included for operation of display 110 and a touch input device integrated with, or separate from, the display. As shown in FIG. 11, device 100 may include touch input device 1100 (e.g., a touch-sensitive and/or force-sensitive layer of display 110 or a touch pad or other touch interface device). A touch input on touch input device 1100 (e.g., by a finger of user 1101 or another touch interface device such as a stylus device) generates touch signals that are processed by touch firmware 1102 and the resulting user input signals are provided to an application 1104 running on device 100. Application 1104 may be a web browser application, an electronic reader application, a video playback application, a social media application, or any other application suitable for running on an electronic device.

Based on the user input signals received from touch firmware 1102, application 1104 generates display content data for graphics processing unit (GPU) 1106. GPU 1106 generates display data for control circuitry 1108 such as a display control circuitry or system control circuitry such as a device processor (e.g., a device central processing unit (CPU)) which generates display control data for backlight controller 1110 and display timing controller (TCON) 1114. TCON 1114 then operates display panel 1116 (e.g., an array of liquid crystal display pixels) to provide the display content at a frame rate corresponding to the type of display content (e.g., static content, scrolling content, video content, etc.). BLC 1110 operates LED array 112 to provide constant and/or pulsed backlight based on a frame rate for panel 1116 provided from control circuitry 1108.

In various examples, GPU 1106, control circuitry 1108, TCON 1114, panel 1116, backlight controller (BLC) 1110, and/or LED array 1112 (in combination with touch input device 1100, if desired) can be integrated into display 110. For example touch input device 1100 can be integrated with display panel 116 which, together with TCON 1114, control circuitry 1108, and GPU 1106, forms LCD unit 204 (in one example).

As shown, during operation of device 100, a touch input received at touch input device 1100 generates signals that are received at application 1104 after a time T1. Application 1104 then generates corresponding signals that are received at display panel 1116 after an additional time T2. In accordance with some aspects of the subject disclosure, touch input device 1100 can also provide a signal directly to control circuitry 1108, as shown, in a time T3 that is less than the combination of times T1 and T2. In this way, backlight controller 1110 can be provided with a notification of an upcoming change in the display refresh rate before the refresh rate is changed at display panel 1116. With this advanced notice, BLC 1110 can begin operating array 1112 with a transition pulse pattern before the refresh rate of panel 1116 changes.

Figure 12:
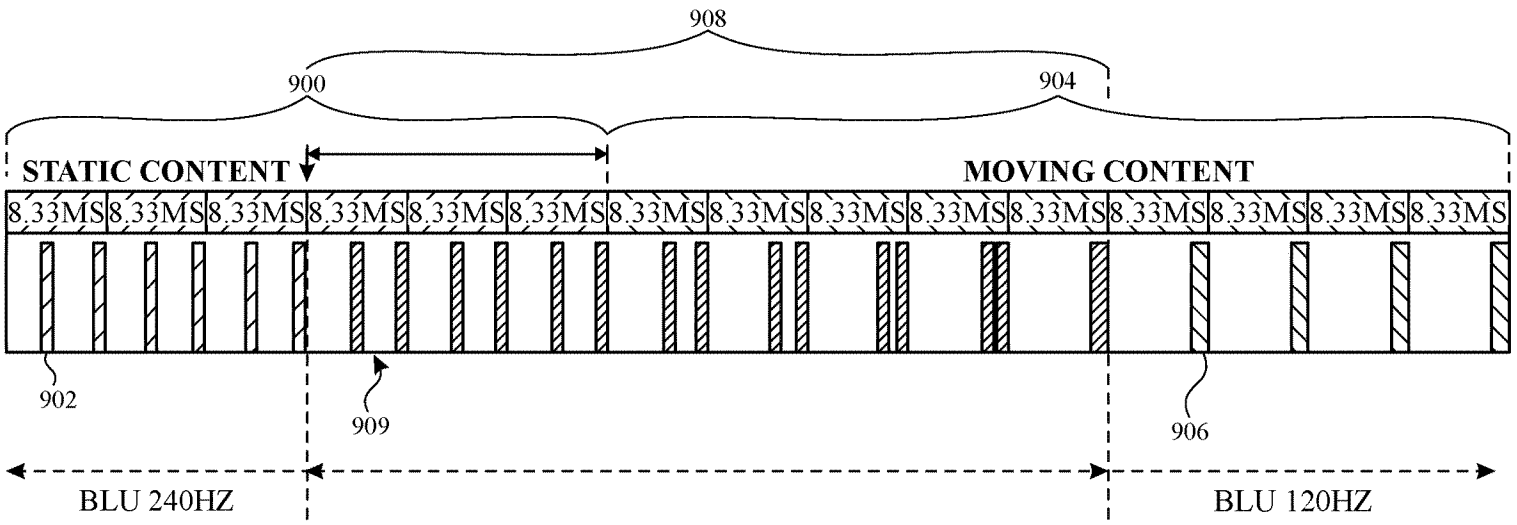
FIG. 12 illustrates a transition pulse pattern for a display backlight that is applied. partially before a frame rate transition in accordance with various aspects of the subject technology.
Figure 13:
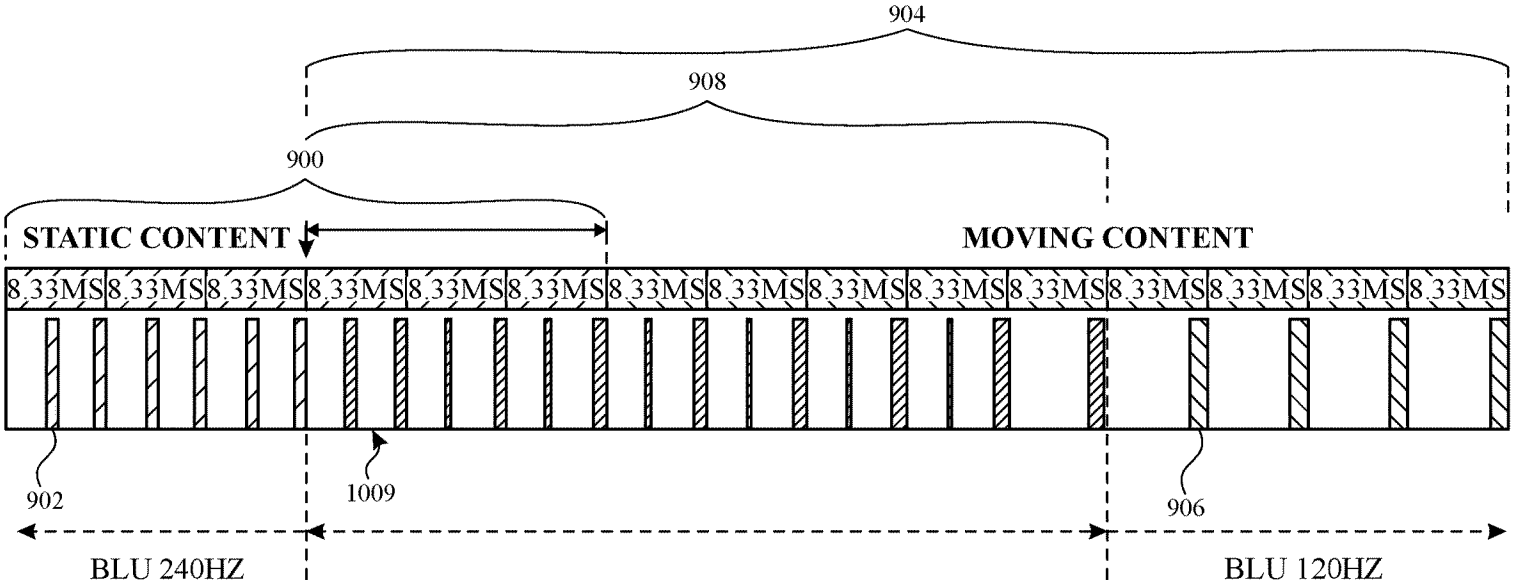
FIG. 13 illustrates another transition pulse pattern for a display backlight that is applied partially before a frame rate transition in accordance with various aspects of the subject technology.

In this way, transition time period 908 can occur partially while providing the first display content at the first LCD frame rate and partially while providing the second display content at the second LCD frame rate. FIGS. 12 and 13, respectively, show transition patterns 909 and 1009 of FIGS. 9 and 10 being applied partially during the display of static content during time period 900. In some scenarios, the notification from touch input device may be sufficiently early to allow the entire backlight transition pattern to be applied before the LCD frame rate changes.

Figure 14:
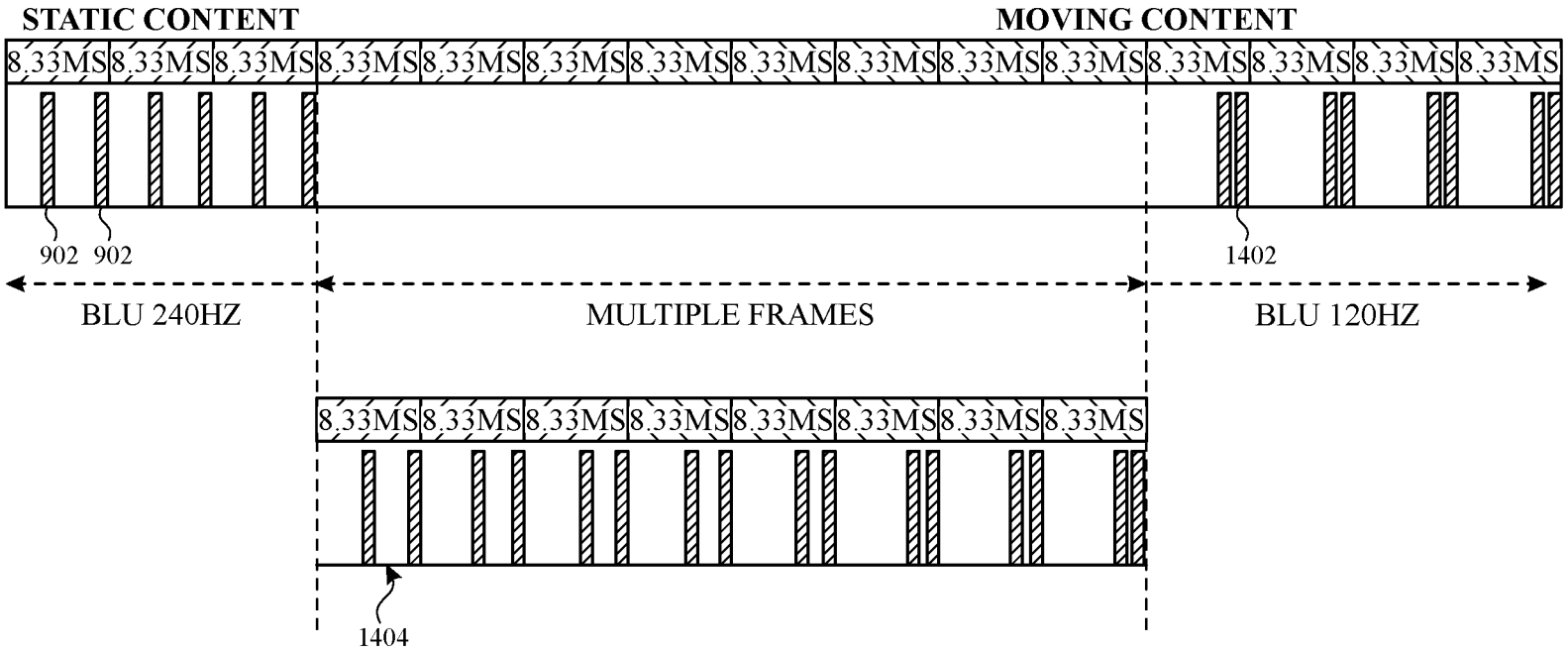
FIG. 14 illustrates yet another transition pulse pattern for a display backlight in accordance with various aspects of the subject technology.

It should also be appreciated that pulse patterns other than individual pulses 902 and 906 for static content and moving content can be applied. As one example, FIG. 14 shows how multiple pulses 1402 can be applied during moving content display and a transition pulse pattern 1404 can be applied that changes over time during the transition period between single pulse 240 Hz backlight operation to double-pulse 120 Hz backlight operation. Although the transition pulse patterns described in connection with FIGS. 9-14 are provided for a 240 Hz to 120 Hz frame rate transition, it should be appreciated that transition pulse patterns can also be provided for other decreasing frame rate transitions and/or for various increasing frame rate transitions.

In the examples of FIGS. 9-11, a separate multi-frame transition pulse pattern is applied before, during, and/or after an LCD frame rate transition. In other scenarios, display artifacts associated with a frame rate transition can be reduced or eliminated by removing the first backlight pulse after a frame rate change (e.g., to allow time for liquid crystal component settling).

Figure 15:
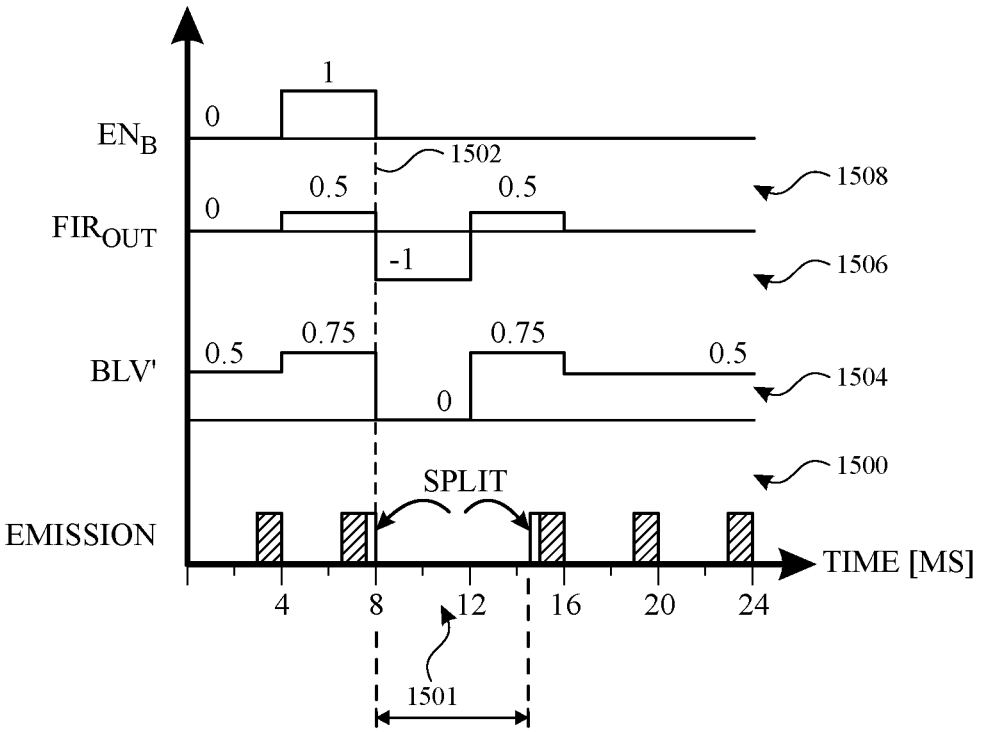
FIG. 15 illustrates a timing diagram for a pulse splitting operation for a display backlight in accordance with various aspects of the subject technology.

FIG. 15 shows an example emission timeline 1500 in which the first pulse 1501 after a frame rate transition 1502 is removed or skipped. However, as shown in FIG. 15, to maintain the overall (e.g., average) brightness of the display, the light that would be generated by skipped pulse 1501 is split or redistributed into other pulses. In the particular example of FIG. 15, pulse 1501 is evenly split into the preceding and following pulses (e.g., by starting each of the preceding and following pulses early and extending their width by half of the pulse width of skipped pulse 1501). Although pulse 1501 is evenly split between preceding and following pulses in the example of FIG. 15, other splits (e.g., uneven splits and/or splits among more than two other pulses) can be applied. Accordingly, removed pulse 1501 can be split up and added, in pieces, to other pulses before and/or after the transition.

FIG. 15 also shows various control signal timelines that may be used for implementing the emission splits shown in emission timeline 1500. For example, backlight value timeline 1504 shows modified backlight values BLV' in the vicinity of pulse 1501 that can be provided to a backlight controller to cause lengthening of the preceding and following pulses and elimination of pulse 1501. Modified backlight values BLV' may be generated based on a digital filter output (e.g., a finite impulse response (FIR) filter output such as FIRout, an infinite impulse response (IIR) filter output or other digital filter output) 1506 having values that cause spreading of the signal for pulse 1501. An enable signal timeline 1508 is also shown that enables pulse spreading operations as shown.

Figure 16:
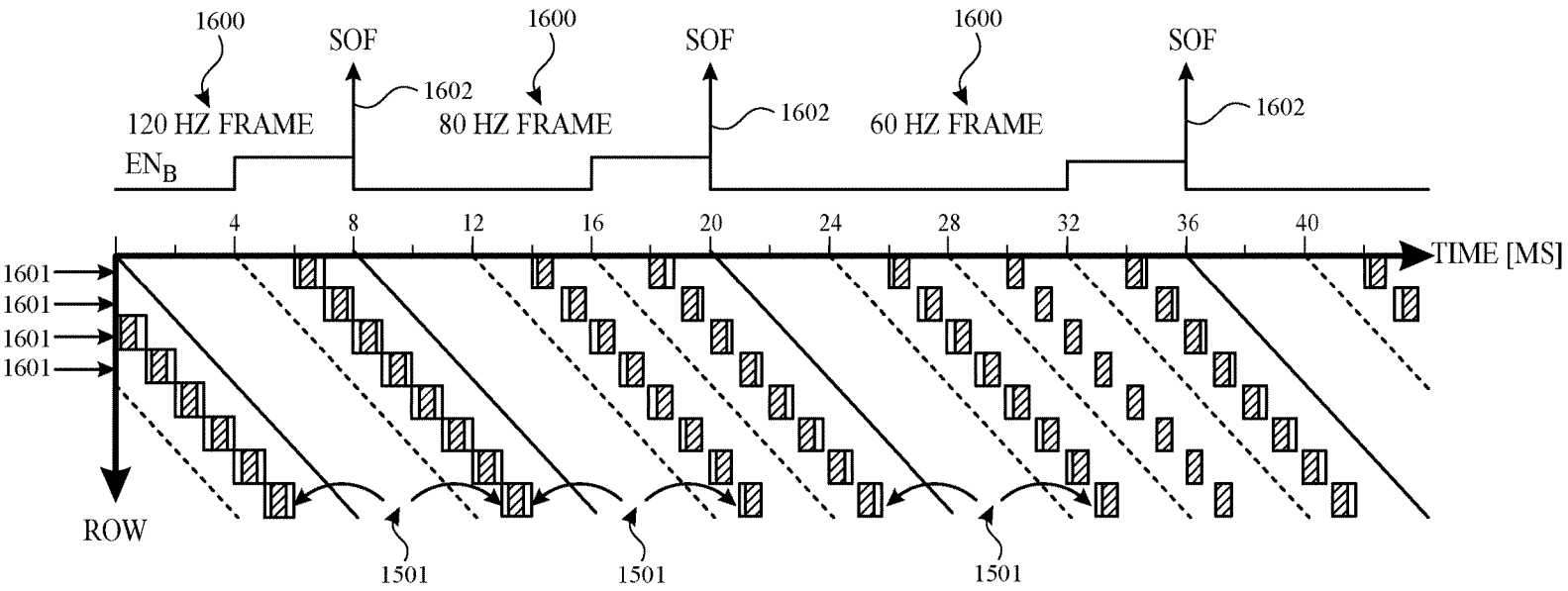
FIG. 16 illustrates a row-by-row application of a pulse splitting operation display backlight in accordance with various aspects of the subject technology.

FIG. 16 shows a row-by-row application of a pulse spreading operation as described in connection with FIG. 15. As shown in FIG. 16, for each row 1601 of backlight LEDs and for each LCD display frame 1600, the first pulse 1501 after the start-of-frame (SoF) 1602 is eliminated and spread into the preceding and following pulses.

Figure 17:
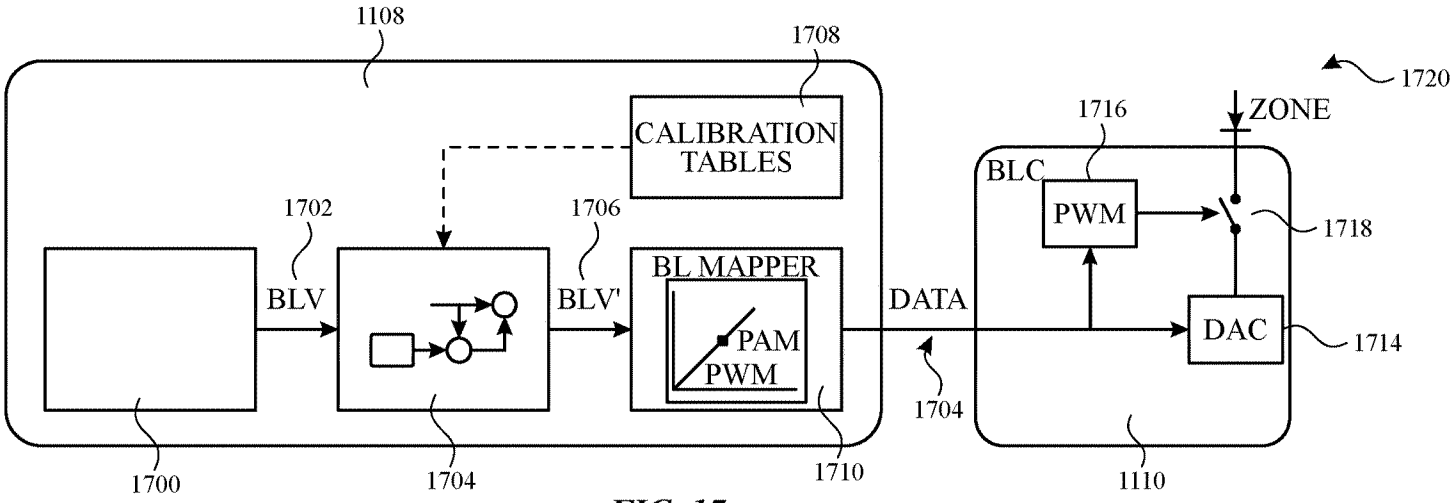
FIG. 17 illustrates a portion of a display architecture for applying pulse splitting with a filter in accordance with various aspects of the subject technology.

FIG. 17 shows a flow diagram in which backlight values 1702 (e.g., original backlight values (BLV)) generated for particular LCD display content by SoC circuitry 1700 are modified to generate modified backlight values 1706 (e.g., modified backlight values BLV' of FIG. 15) Modified backlight values 1706 cause the pulsing at the frame rate transition to be eliminated. and/or split. Backlight values BLV indicate a desired amount of light at a given time.

More specifically, in the example of FIG. 17, filtering module 1704 is provided to modify original backlight values BLV to form modified backlight values BLV' based on one or more calibration tables 1708 (e.g., including filter tap values). A backlight mapper module 1710 may be provided to generate control data 1712 for backlight controller 1110 by mapping the modified backlight value BLV' to, for example, pulse widths and/or pulse amplitudes for control of a backlight LEI) 1720 using a pulse width modulation (PWM) controller 1716 and switch 1718 and/or using current controller (DAC) 1714.

In the example of FIGS. 15 and 16, pulse 1501 is broken into two components and the two components are moved to a different time. However, further reductions in visible artifacts can be provided with further spreading of the removed pulse using, for example, a digital filter implementation with predetermined tapping values. Calibration tables 1708 may, for example, store filter tap values or weights to be used in a digital filter module for splitting each pulse 1501 for various frame rate transitions. The digital filter may be an FIR filter, an IIR filter, or any other suitable digital filter.

Figure 18:
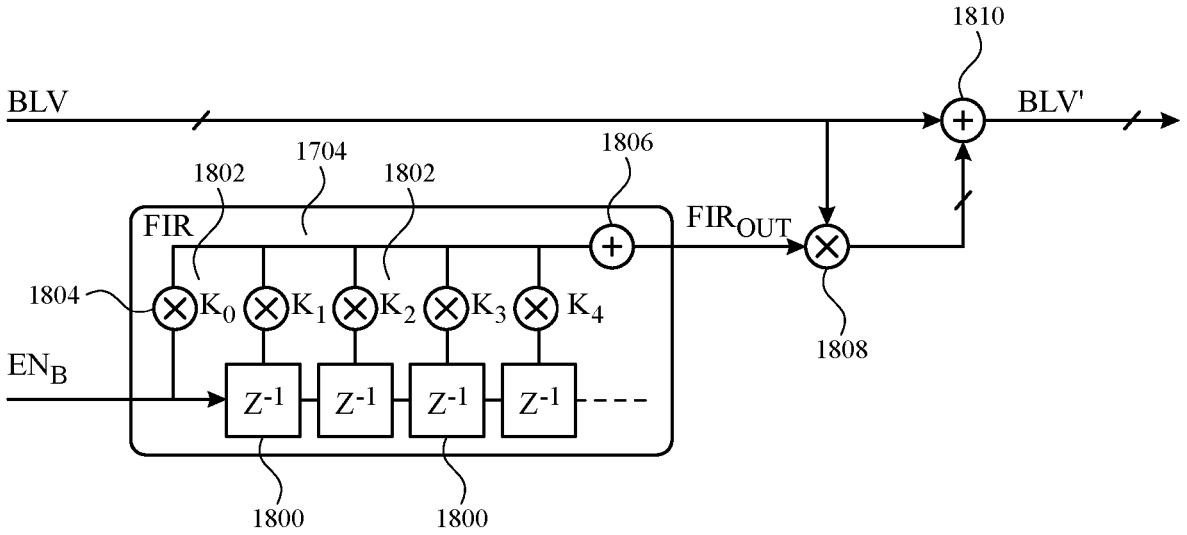
FIG. 18 illustrates a finite impulse response (FIR) filter in accordance with various aspects of the subject technology.

FIG. 18 shows an example FIR implementation of filtering module 1704. As shown in FIG. 18, filtering module 1704 may include a plurality of delay circuits 1800 that delay enable signal EN to generate a filter module pulse train output FIRout. FIRout is generated by multiplying the delayed EN signal at various times by a weight or filter tap value $k_n$ (e.g., $k_0$, $k_1$, etc. in FIG. 18) associated with that time (e.g., using multipliers 1804) and combining the results for all n with adder 1806. The output FIRout of filtering module 1704 at any given time is then multiplied (by multiplier 1808) by the original backlight value BLV, which is also added (by adder 1810) to the result of the multiplication to generate the modified backlight value BLV'.

In this way, a filtering module 1704 of suitable length can be provided with tapping values 1802 that spread pulse 1501 among various preceding and following pulses to reduce or eliminate visible artifacts associated with any LCD frame rate transition. For example, a specific set of filter tap values 1802 may be chosen for each frame rate transition to spread a backlight pulse in a way that strongly attenuates pulsing at frequencies to which the human eye is sensitive.

Filter tap values 1802 can be selected to reduce visible artifacts caused by backlight pulsing adjustments for frame rate transitions from 240 Hz to 120 Hz, for transitions between one 80 Hz frame in a train of 120 Hz frames, for transitions between one 60 Hz frame in a train of 120 Hz frames, for other frame rate transitions and/or for frame rate phase shifts. For example, the GPU can sometimes cause a phase shift between display frames and backlight pulses. Filter tap values 1802 can be selected to allow a flicker free correction for such a display frame phase shift.

Figure 19:
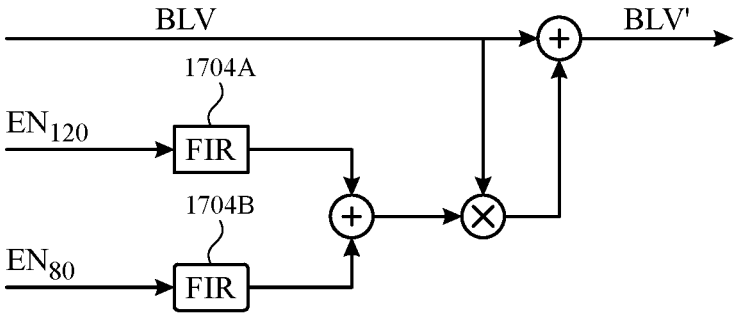
FIG. 19 illustrates backlight circuitry that includes two FIR filters in accordance with various aspects of the subject technology.
Figure 20:
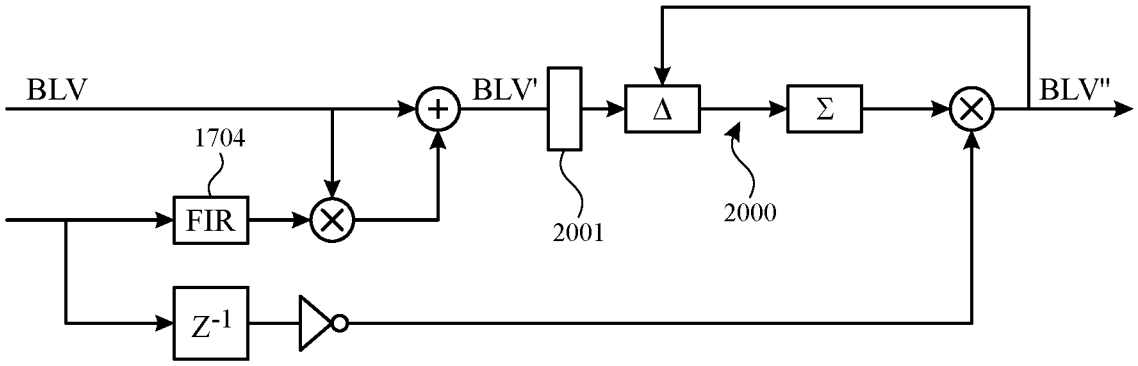
FIG. 20 illustrates backlight circuitry that includes a FIR filter and sigma-delta circuitry in accordance with various aspects of the subject technology.

The arrangement of filtering circuitry in FIG. 18 is merely illustrative and other filtering circuitry arrangements can be provided. For example, FIG. 19 shows an example in which the original backlight values BLV are modified using multiple parallel filtering modules 1704A and 1704B, that combine to use multiple corresponding enable signals $EN_{120}$ and $EN_{80}$ to generate more complex patterns of modified backlight values BLV'. As another example, FIG. 20 shows how clipping circuitry 2001 and delta-sigma circuitry 2000 can be provided with filtering module 1704 to compensate for, for example, modified backlight values BLV' that are too small to be generated by the available hardware (e.g., by generating further modified backlight values BLV").

Figure 21:
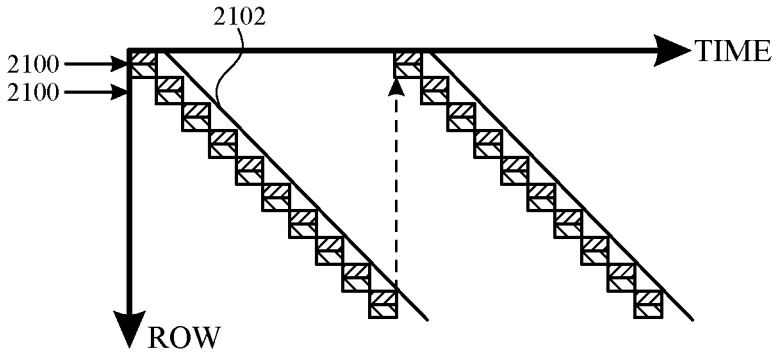
FIG. 21 illustrates a timeline of pairwise row operations for a display backlight in accordance with various aspects of the subject technology.

FIG. 21 shows how, if desired, pairs 2100 of rows of backlight LEDs can be operated together. In the example of FIG. 21, just after providing a pulse of backlight with a pair 2100 of rows of backlight LEDs, an LCD update 2102 for the LCD unit is provided. In this way, the LCD is provided with time to settle between backlight pulses and synchronization between backlight LED pulsing and LCD updating can be enhanced.

Figure 22:
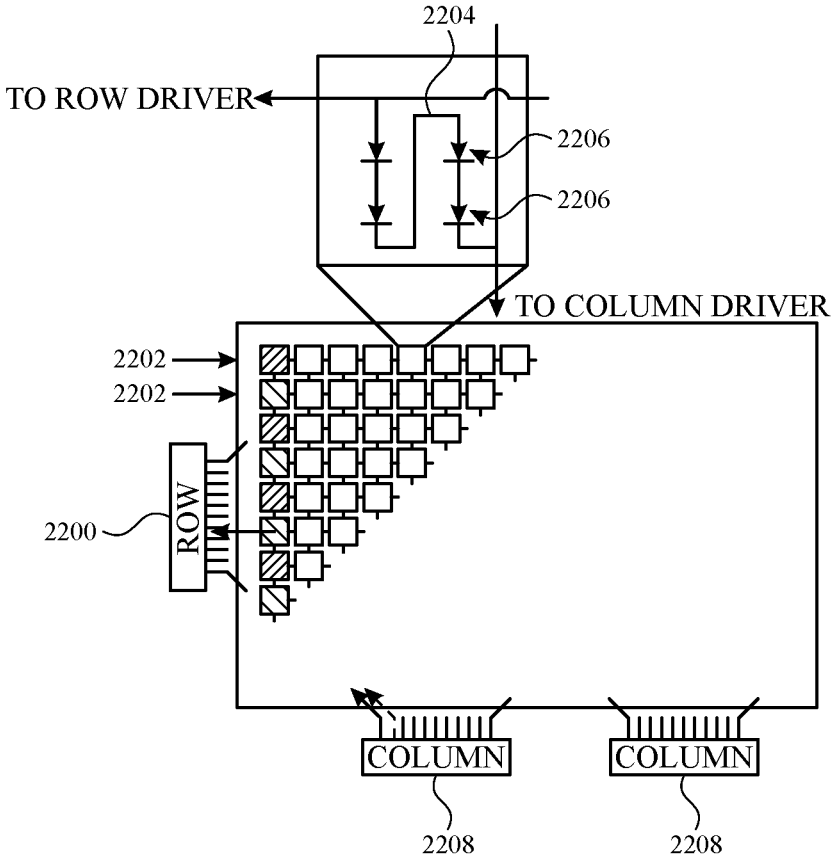
FIG. 22 illustrates dual column driver circuitry for a display backlight LED array in accordance with various aspects of the subject technology.

In order to operate pairs 2100 of LED rows together, multiple backlight LED column drivers 2208 can be provided as shown in FIG. 22. In the example of FIG. 22, each row 2202 of BLU 202 includes a linear array of stings 2204 of LEDs 2206 coupled to a single row driver 2200. When row driver 2200 enables a pair of rows 2202, a column driver 2208 for each row of the pair controls the brightness of the LEDs 2206 in that row.

In the examples of FIGS. 15-20, a pulse of the backlight at or near a frame rate transition for the LCS is spread among other pulses using, for example, an FIR filter module based on a provided enable signal. However, in some implementations, a decision engine may be provided for the display so that predetermined transition pulse patterns can be selected for each of several corresponding LCD frame rate transitions.

Figure 23:
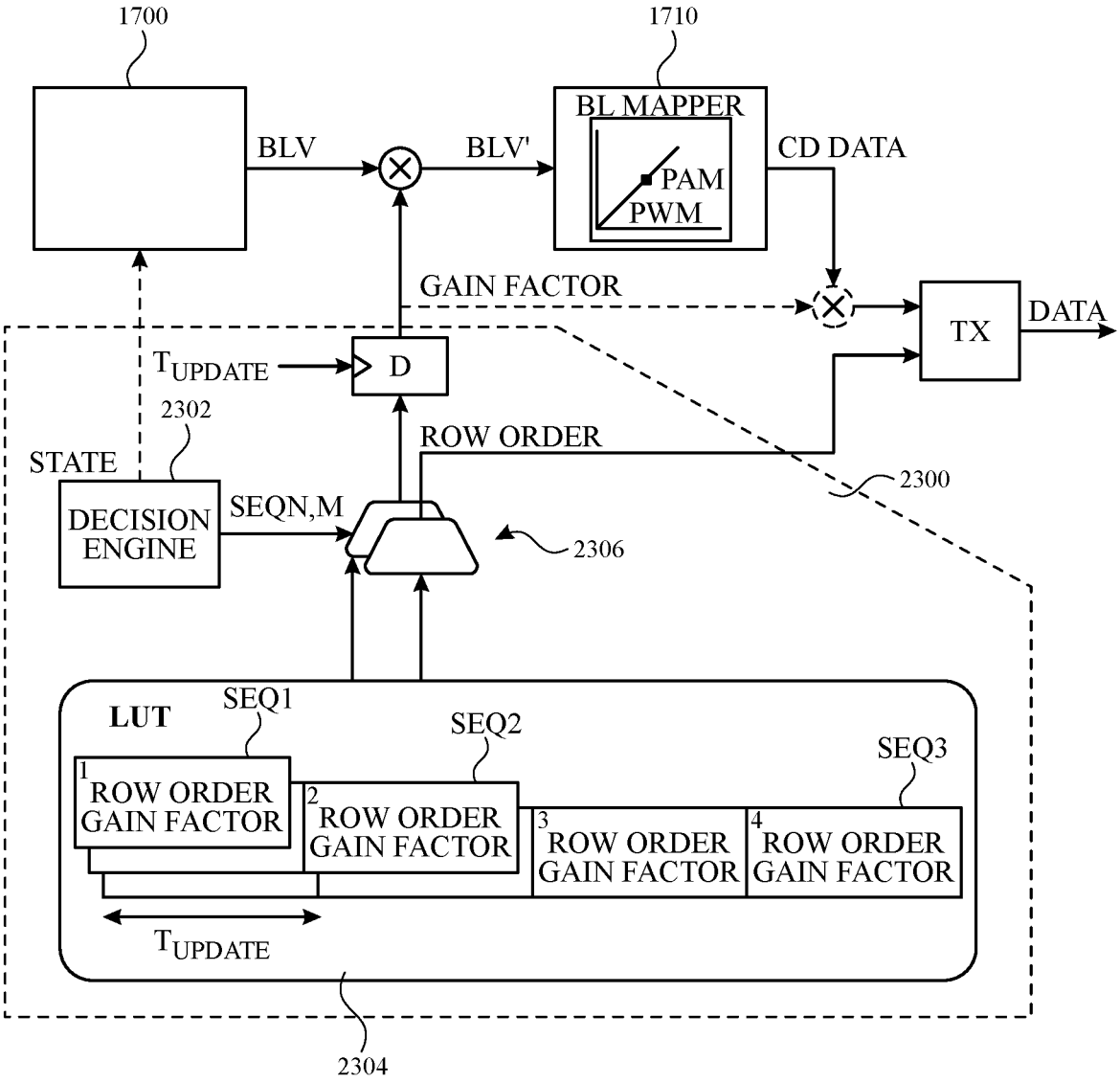
FIG. 23 illustrates a portion of a display architecture that includes a decision engine for backlight pulse pattern control in accordance with various aspects of the subject technology.

FIG. 23 shows an example of display circuitry including a decision engine for selecting transition pulse patterns for specific LCD frame rate transitions and/or steady-state pulse patterns for specific LCD frame rates. In the example of FIG. 23, the original backlight values BLV generated by SoC circuitry 1700 are modified by a transition control circuit 2300 (e.g., implemented in firmware coupled to the display SoC). As shown, transition control circuitry 2300 includes decision engine 2302 and lookup table (LUT) storage 2304. Decision engine 2302 selects a predetermined transition pulse pattern from LUT storage 2304 when a corresponding LCD frame rate transition is identified. The transition pulse patterns stored in LUT storage 2304 are predetermined to prevent visible artifacts on the display when a corresponding LCD frame rate change occurs (e.g., predetermined using the modeling techniques described herein).

In the example of FIG. 23, the transition pulse patterns are each embodied in a sequence (e.g., Seq1, Seq2, and Seq3) stored in LUT storage 2304. Decision engine 2302 selects one of the stored sequences by providing a selection signal to one or more multiplexers 2306 to select one of the stored sequences, in the example of FIG. 23.

In some scenarios, it is desirable to provide pulse patterns with gains for modifying the brightness or length of a pulse and timing information for the pulses (such as a row order) that defines the order and timing with which various pulses in a transition pulse pattern are applied to which row. As shown, gain factor(s) in the selected sequence can be applied to modify the original backlight values BLV into modified backlight values BLV' prior to mapping to PWM or PAM values, or the gain factor(s) can be applied after mapping. Row order values in the stored sequences can be applied to control the timing of backlight pulses to provide the desired transition pulse pattern in various LED rows. Sequences corresponding to backlight pulse patterns can be stored in LUT storage for steady-state pulse patterns to be applied for a specific LCD frame rate and/or transition pulse patterns to be applied at or near specific transitions between specific LCD frame rates.

Figure 24A:
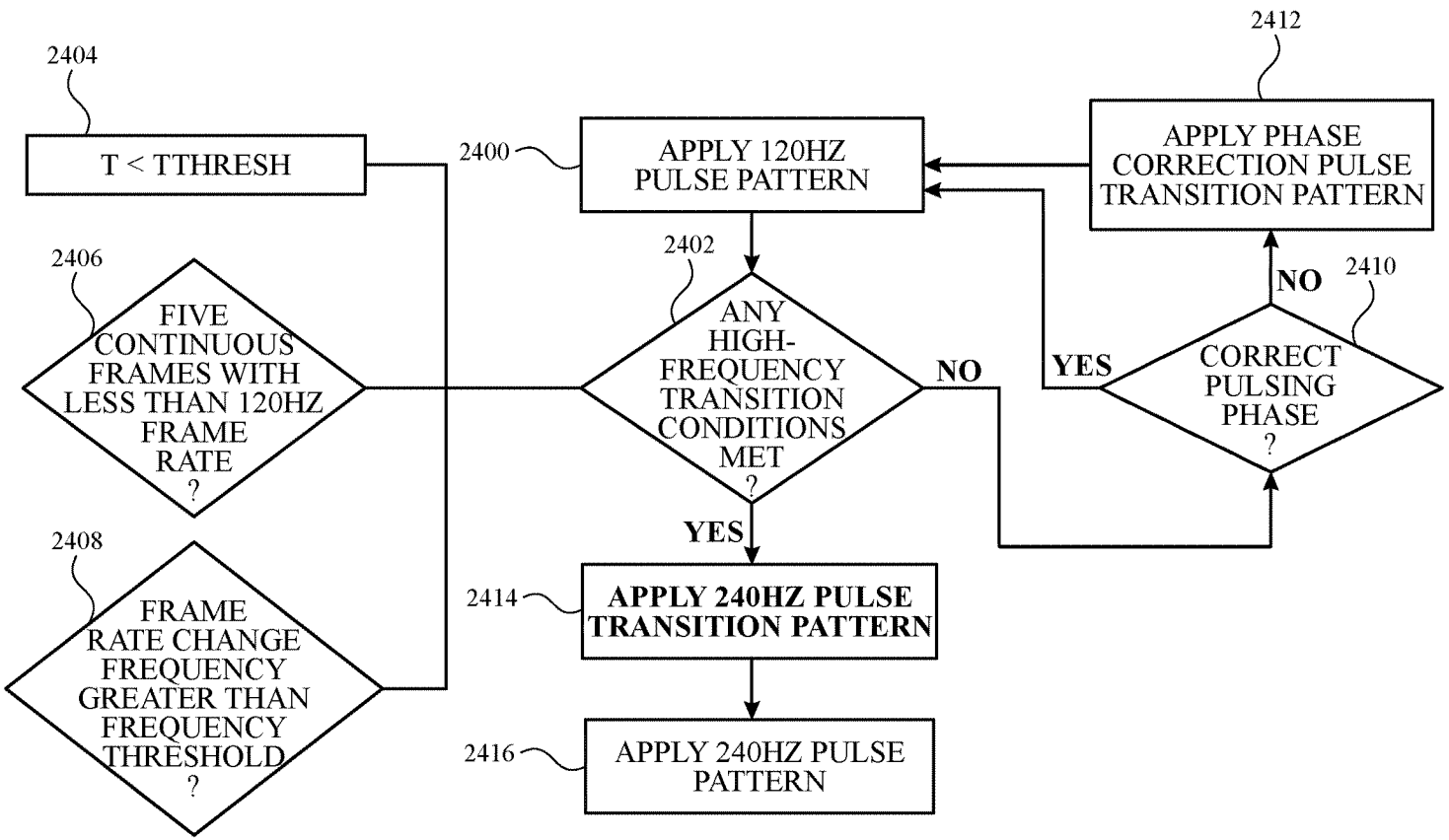
FIG. 24A is a flow chart of illustrative operations that may be performed by a decision engine associated with backlight circuitry during a low-frequency pulse pattern operation in accordance with various aspects of the subject technology.
Figure 24B:
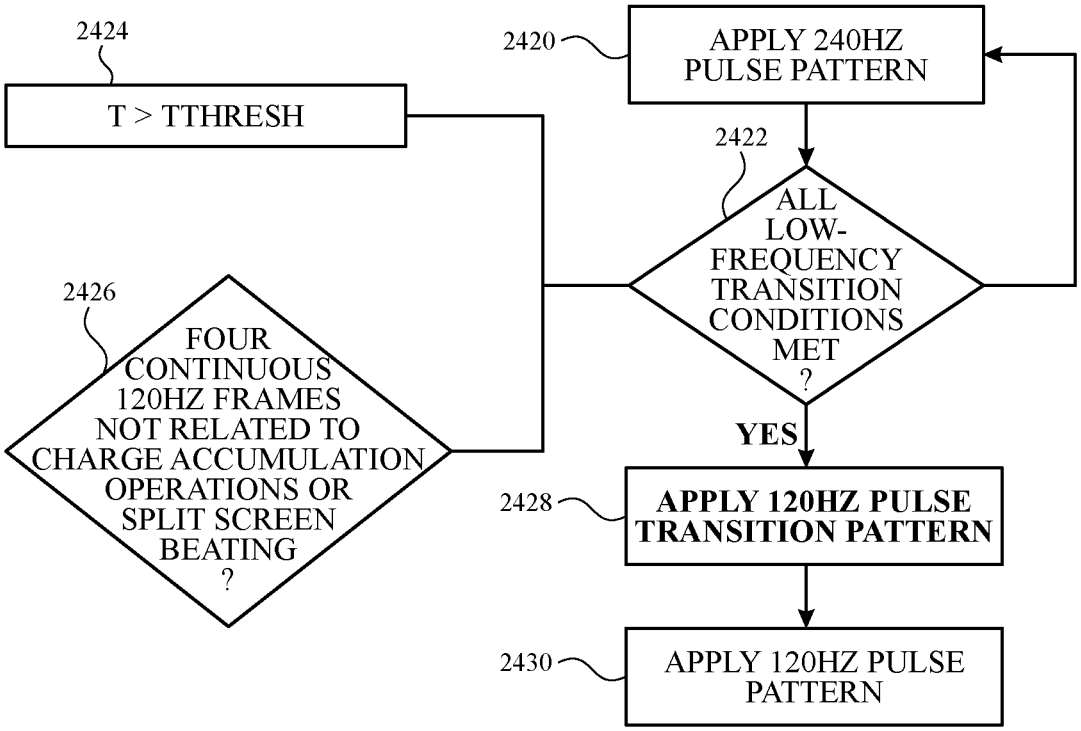
FIG. 24B is a flow chart of illustrative operations that may be performed by a decision engine associated with backlight circuitry during a high-frequency pulse pattern operation in accordance with various aspects of the subject technology.

FIGS. 24A and 24B show illustrative operations that can be performed (e.g., using decision engine 2302 and BLU 202) to select and apply an appropriate transition pulse pattern for each of various LCD frame rate changes. For example, FIG. 24A shows illustrative operations that can be performed for transitioning from a low-frequency backlight pulsing pattern to a high-frequency backlight pulsing pattern.

At block 2400, a low-frequency pulse pattern, such as a 120 Hz pulse pattern with a single backlight pulse per 120 Hz LCD display frame, is provided to avoid motion blur effects on the display (e.g., while moving content is displayed). However, in some scenarios (e.g., to prevent strobing effects when static content is displayed), it may be desirable to increase the frequency of the backlight pulses (e.g., to a 240 Hz pulse pattern). Before causing an increase in backlight pulsing frequency, decision engine 2302 checks various display conditions at block 2402.

In particular, at block 2402, decision engine 2302 determines whether any high-frequency transition conditions are met. As shown in FIG. 24A, the high-frequency transition conditions may include a display temperature condition, a low-frame rate detection condition, and a frame rate change frequency condition.

In particular, at block 2404, while backlight unit 202 provides a low frequency (e.g., 120 Hz) pulse pattern, decision engine 2302 determines whether a temperature of the display is less than a temperature threshold for reduced-frequency pulsing. For example, the temperature threshold may be 10 degrees Centigrade. If the temperature is determined to be below the threshold, decision engine 2302 obtains a transition pulse pattern for transitioning from the lower frequency (e.g., 120 Hz) pulse pattern to the high frequency (e.g., 240 Hz or higher) pulse pattern and backlight unit 202 operates the backlight LEDs with the Obtained transition pulse pattern for that transition at block 2414, after which backlight unit 202 operates the backlight LEDs with the high frequency pulse pattern at block 2416.

At block 2406, while backlight unit 202 provides a low frequency (e.g., 120 Hz) pulse pattern, decision engine 2302 determines whether a number (e.g., five) of continuous lower frequency (e.g., less than 120 Hz) LCD display frames have occurred. If so, decision engine 2302 obtains the transition pulse pattern for transitioning from the lower frequency (e.g., 120 Hz) pulse pattern to the high frequency (e.g., 240 Hz or higher) pulse pattern and backlight unit 202 operates the backlight LEDs with the obtained transition pulse pattern for that transition at block 2414, after which backlight unit 202 operates the backlight LEDs with the high frequency pulse pattern at block 2416.

At block 2408, while backlight unit 202 provides a low frequency (e.g., 120 Hz) pulse pattern, decision engine 2302 determines whether the LCD frame rate has changed with a change frequency above a frequency threshold (e.g., a 25 percent threshold). If so, decision engine 2302 obtains the transition pulse pattern for transitioning from the lower frequency (e.g., 120 Hz) pulse pattern to the high frequency (e.g., 240 Hz or higher) pulse pattern and backlight unit 202 operates the backlight LEDs with the obtained transition pulse pattern for that transition at block 2414, after which backlight unit 202 operates the backlight LEDs with the high frequency pulse pattern at block 2416.

If, at block 2402 (e.g., after the operations of blocks 2404, 2406, and 2408), decision engine 2302 determines that no high-frequency transition conditions are met, decision engine 2302 and/or BLU 202 may return to block 2400 to continue operating the backlight LEDs with the low-frequency pulse pattern. However, in some scenarios, a phase shift (e.g., a 180 degree phase shift) in the LCD display frames can occur when the GPU delays a frame for additional processing). As shown in FIG. 24, at block 2410, while backlight unit 202 provides a low frequency (e.g., 120 Hz) pulse pattern, decision engine 2302 may determine whether the low frequency pulses are being provided with the correct phase with respect to the LCD display frames (e.g., by determining whether an LCD frame phase shift has occurred). If decision engine 2302 determines that the pulsing phase is correct, decision engine 2302 and/or BLU 202 may return to block 2400 to continue operating the backlight LEDs with the low-frequency pulse pattern. If decision engine 2302 determines that the pulsing phase is incorrect, decision engine 2302 obtains the transition pulse pattern for a frame phase correction and backlight unit 202 operates the backlight LEDs with the obtained phase correction transition pulse pattern at block 2412, after which backlight unit 202 continues to operate the backlight LEDs with the low frequency pulse pattern at block 2416.

FIG. 24B shows illustrative operations that can be performed for transitioning from a high-frequency backlight pulsing pattern to a low-frequency backlight pulsing pattern.

At block 2420, a high-frequency pulse pattern such as a 240 Hz pulse pattern is provided to avoid visible strobing effects on the display (e.g., while static content is display). However, in some scenarios (e.g., to reduce motion blur when moving content is displayed), it may be desirable to reduce the frequency of the backlight pulses (e.g., to a single pulse during each 120 Hz frame). Before causing a reduction in backlight pulsing, decision engine 2302 checks various display conditions at block 2422.

In particular, at block 2422, decision engine 2302 determines whether all low-frequency transition conditions are met. As shown in FIG. 24B, the low-frequency transition conditions may include a display temperature condition and a high-frame rate detection condition.

In particular, at block 2424, while backlight unit 202 provides a high frequency (e.g., 240 Hz) pulse pattern, decision engine 2302 determines whether a temperature of the display is greater than or equal to a temperature threshold for reduced-frequency pulsing. For example, the temperature threshold may be 10 degrees Centigrade. Decision engine 2302 may also determine at block 2426 whether a number (e.g., four) of continuous low-frequency LCD display frames (e.g., continuous frames that are not related to charge accumulation operations or split screen beating for the display) have occurred. If the temperature is determined to be greater than or equal to the threshold and the number of continuous low-frequency LCD display frames have occurred, decision engine 2302 obtains a transition pulse pattern for transitioning from the higher frequency (e.g., 240 Hz or higher) pulse pattern to the low frequency (e.g., 120 Hz) pulse pattern and backlight unit 202 operates the backlight LEDs with the Obtained transition pulse pattern for that transition at block 2428, after which backlight unit 202 operates the backlight LEDs with the low frequency pulse pattern at block 2430.

Figure 25:
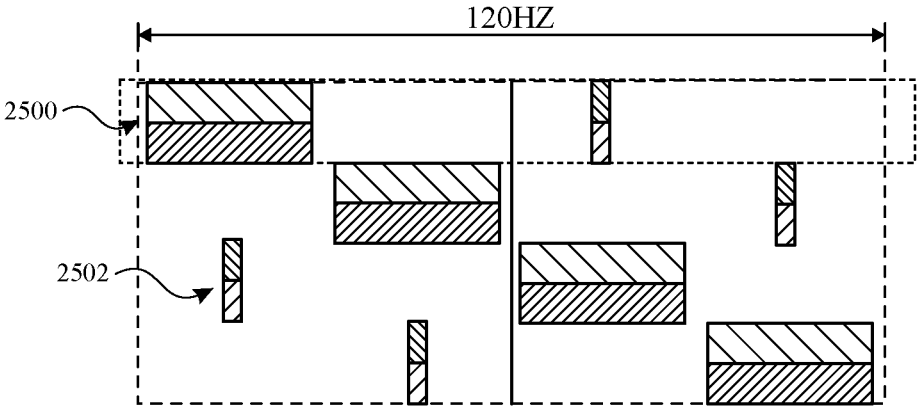
FIG. 25 illustrates a timeline of backlight row pulsing with overlapping steady state and transition pulses in accordance with various aspects of the subject technology.

In some scenarios, transition pulse patterns for some backlight rows can overlap the steady state pulse patterns for other rows. FIG. 25 shows an example in which steady state pulses 2500 for some row pairs overlap in time with transition pulses 2502 for other row pairs. Accordingly, more than two column drivers (see, e.g., FIGS. 21 and 22) can be provided, in some implementations, to allow overlapping pulses in addition to the dual row driving described above in connection with FIGS. 21 and 22.

Figure 26A:
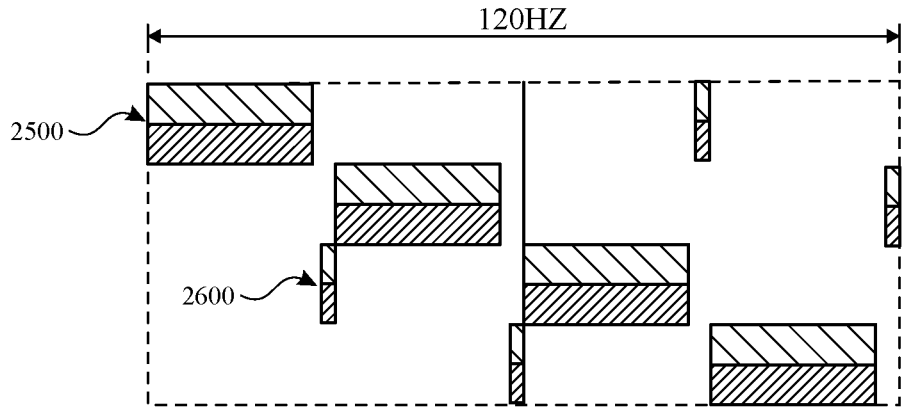
FIG. 26A illustrates a timeline of backlight row pulsing with time interleaved steady state and transition pulses in accordance with various aspects of the subject technology.
Figure 26B:
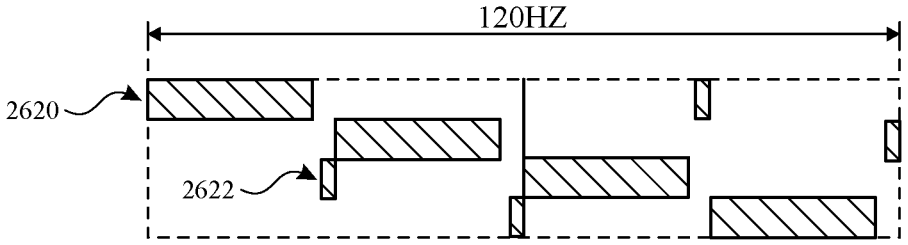
FIG. 26B illustrates a timeline of backlight row pulsing with time interleaved steady state and transition pulses with a single column driver in accordance with various aspects of the subject technology

However, to reduce the number of column drivers, backlight pulse patterns (e.g., steady state low or high frequency pulse patterns and/or transition pulse patterns stored in LUT storage 2304) can be arranged (e.g., by arranging the row order and gains) such that steady state pulses 2500 are interleaved in time with transition pulses 2600 as shown in the example of FIG. 26A. FIG. 26B shows another example in which a single column driver is used to provide steady state pulses 2620 and transition pulses 2622 for individual rows rather than row pairs as in the example of FIG. 26A.

Figure 27:
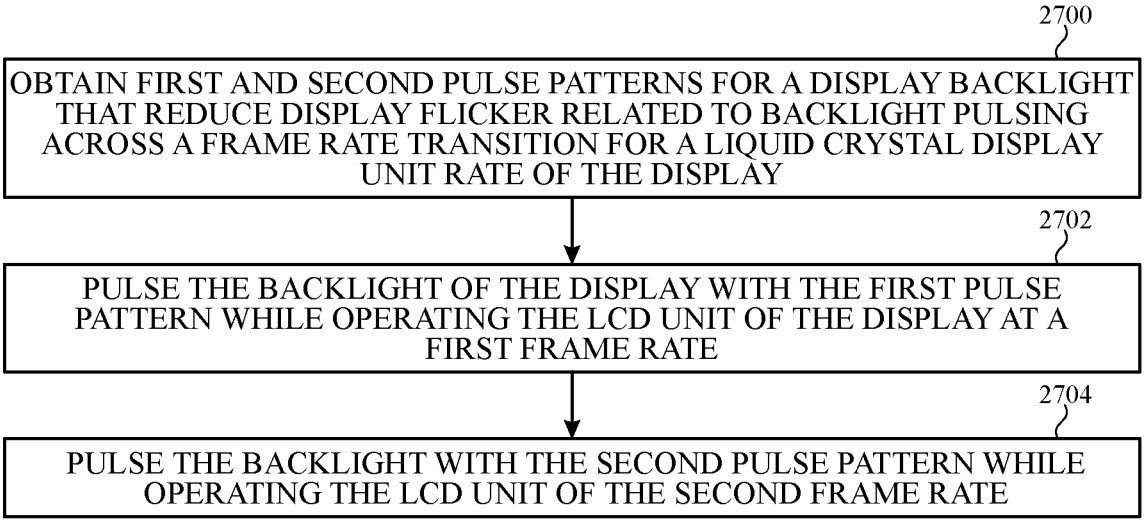
FIG. 27 is a flow chart of illustrative operations that may be performed for single frame frame-rate transitioning in accordance with various aspects of the subject technology.

FIG. 27 depicts a flow diagram of an example process for a flicker-free single frame frame-rate transition with a pulsed backlight operation, in accordance with various aspects of the subject technology. For explanatory purposes, the example process of FIG. 27 is described herein with reference to the components of FIGS. 5-8. Further for explanatory purposes, the blocks of the example process of FIG. 27 are described herein as occurring in series, or linearly. However, multiple blocks of the example process of FIG. 27 may occur in parallel. In addition, the blocks of the example process of FIG. 27 need not be performed in the order shown and/or one or more of the blocks of the example process of FIG. 27 need not be performed.

In the depicted example flow diagram, at block 2700, first and second pulse patterns are obtained for a display backlight that reduce display flicker related to backlight pulsing across a frame rate transition of a liquid crystal display (LCD) unit of the display. The first pulse pattern may be, for example, one of pulse patterns 500 or 800 as described herein. The second pulse pattern may be, for example, one of pulse patterns 504 or 804 as described herein.

At block 2702, the backlight of the display is pulsed with the first pulse pattern while operating the LCD unit of the display at a first frame rate.

At block 2704, the backlight of the display is pulsed with the second pulse pattern while operating the LCD unit of the display at a second frame rate. The second pulse pattern may be applied during all LCD frames at the second frame rate without providing a transition pulse pattern between applying the first and second pulse patterns.

Figure 28:
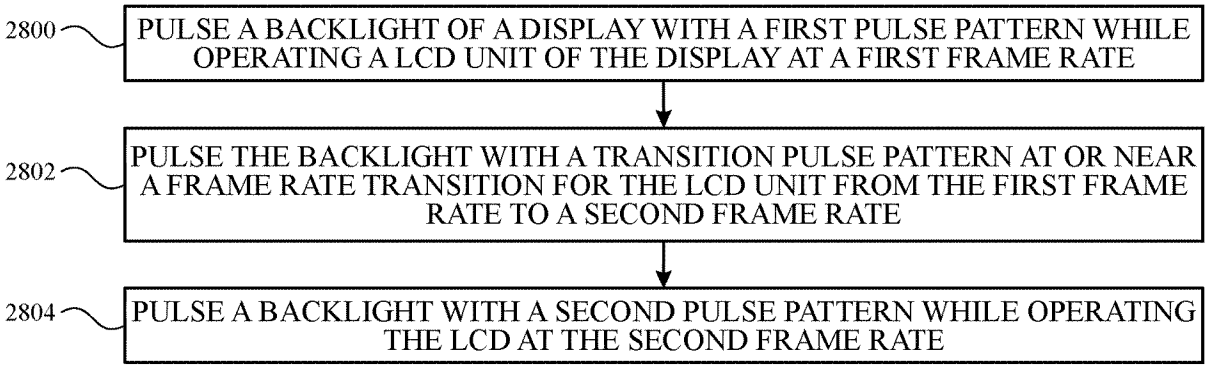
FIG. 28 is a flow chart of illustrative operations that may be performed for applying a transition pulse pattern for a frame rate transition in accordance with various aspects of the subject technology.

FIG. 28 depicts a flow diagram of an example process for a flicker-free frame-rate transition with a pulsed backlight operation that includes a transition pulse pattern, in accordance with various aspects of the subject technology. For explanatory purposes, the example process of FIG. 28 is described herein with reference to the components of FIGS. 9-14, 15-22, and/or 23-26. Further for explanatory purposes, the blocks of the example process of FIG. 28 are described herein as occurring in series, or linearly. However, multiple blocks of the example process of FIG. 28 may occur in parallel. In addition, the blocks of the example process of FIG. 28 need not be performed in the order shown and/or one or more of the blocks of the example process of FIG. 28 need not be performed.

In the depicted example flow diagram, at block 2800, a backlight of a display is pulsed with a first pulse pattern while operating a LCD unit of the display at a first frame rate. The first pulse pattern may include, for example, pulses 902, pulses similar to the first emission pulse shown in FIG. 15, or other steady-state pulses for the first frame rate as described herein.

At block 2802, the backlight is pulsed with a transition pulse pattern at or near a frame rate transition for the LCD unit from the first frame rate to a second frame rate. The transition pulse pattern may be, for example, transition pulse pattern 909, transition pulse pattern 1009, transition pulse pattern 1404, a splitting of a first pulse after the transition as described in connection with FIGS. 15-22, and/or may be a stored transition pattern that is specific to the LCD frame-rate transition that is occurring as selected by a decision engine as described in connection with FIGS. 23-76.

At block 2804, the backlight of the display is pulsed with the second pulse pattern while operating the LCD unit of the display at a second frame rate. The transition pulse pattern may be applied while operating the LCD unit entirely with the first frame rate, entirely with the second frame rate, or partially during operation of the LCD unit with both the first and second frame rates.

Figure 29:
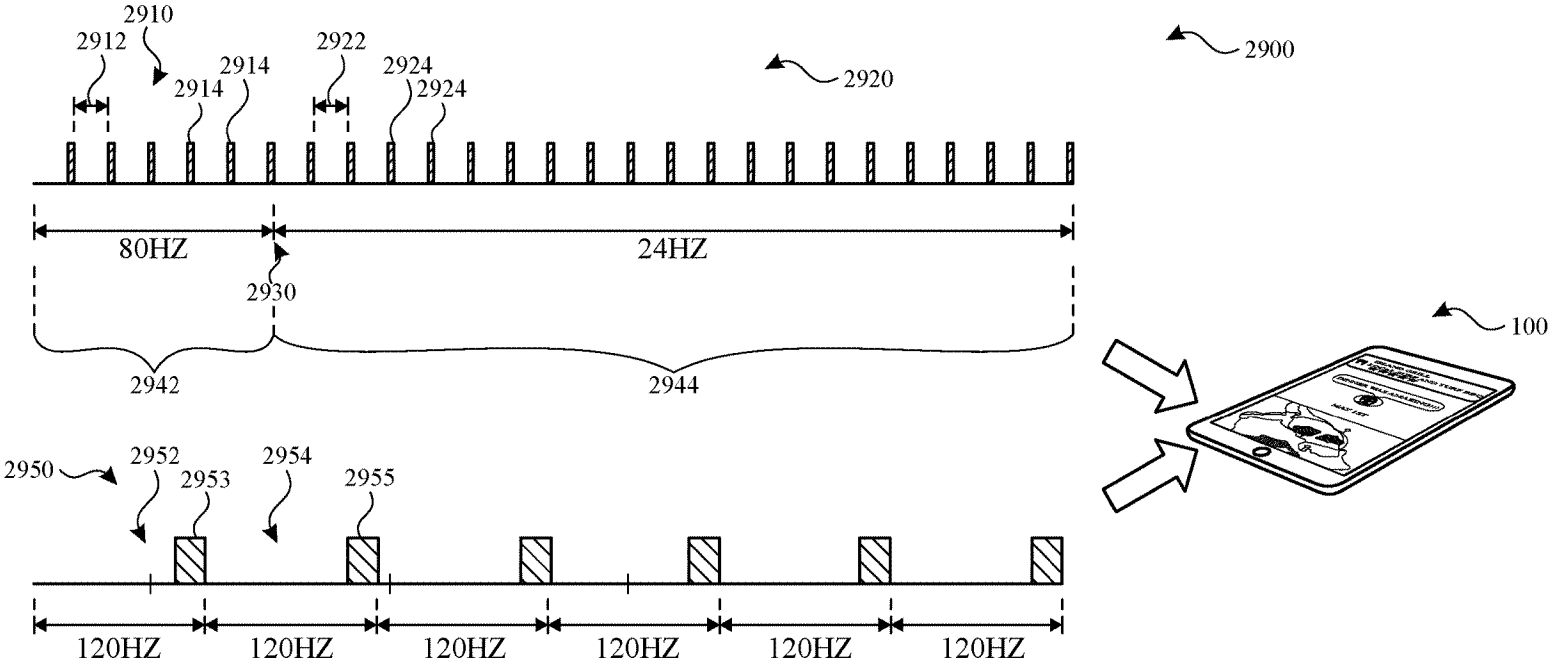
FIG. 29 shows a first example timeline of backlight pulses and a second example timeline of backlight pulses, for each of several LCD frames in accordance with various aspects of the subject technology.

FIG. 29 shows a first example timeline 2900 that includes a first steady state pulse pattern of backlight pulses and a second example timeline 2950 that includes a second steady state pulse pattern of backlight pulses, for each of several LCD frames. The first steady state pulse pattern represents a high-persistence (HP) mode, in which the backlight strobing frequency is 480 Hz and is used for all refresh rates less than 100 Hz. The second steady state pulse pattern represents a low-persistence (LP) mode, in which a single strobe per frame is used for refresh rates at 120 Hz. As shown in FIG. 29, during a time period 2942 while first display content is displayed by LCD unit 204, backlight unit 202 provides backlight pulses 2914 in a first frame 2910 (e.g., with a frame rate of 80 Hz and spaced apart by a separation time 2912) as part of the first steady state pulse pattern. At transition time 2930 and responsive to the change in frame rate of the LCD, BLU 202 eventually begins providing backlight pulses 2924 in a second frame 2920 (e.g., with a frame rate of 24 Hz and spaced apart by a separation time 2922) during a time period 2944 as part of the first steady state pulse pattern.

In the first timeline 2900, two backlight pulses 2924 having the same width as the two backlight pulses 2914 for the first frame 2910 are provided in the second frame 2920. Although the second frame 2920 is more than three times as long as the first frame 2910, the first steady state pulse pattern provides a 480 Hz strobing frequency. In some aspects, other strobing frequencies can include 20 kHz, 1 kHz, etc. During the time period 2942, the frame 2910 is considered an LC frame, where the LC frame has a frame rate of 80 Hz, which includes 6 backlight pulses at the 80 Hz frame rate. Given that the frame rate of the frame 2910 is 80 Hz, the backlight strobing rate can operate 6 times greater to equate a strobing frequency of 480 Hz. During the time period 2944, the frame 2920 has a frame rate of 24 Hz, which includes 20 backlight pulses at the 24 Hz frame rate. Given that the frame rate of the frame 2910 is 24 Hz, the backlight strobing rate is operating 20 times greater to equate the strobing frequency of 480 Hz. In some aspects, backlight pulses operating at or above 480 Hz can help avoid strobing effects. In some implementations, the example of FIG. 29 such as the steady state pulse pattern in the high-persistence mode with a relatively high backlight strobing frequency (e.g., higher than 480 Hz) can be applicable for refresh rates other than 120 Hz, e.g., 80 Hz, 24 Hz, or any refresh rate where moving content is not critical or is not at high speed. In some aspects, the backlight can be strobed at a high frequency (e.g., 480 Hz), which gives the appearance of an always-on backlight state for low refresh rates. At low refresh rates, there is no user interaction and there are no fast moving objects on display so the always-on backlight state is acceptable. Furthermore, a steady state pulse pattern in a low persistence mode can have a single strobe per frame to reduce motion blur so that the backlight strobing frequency can equal to the frame rate, e.g., 120 Hz strobing.

In the example of FIG. 29, the second timeline 2950 includes the second steady-state backlight pulse pattern, which includes, among others, a single backlight pulse 2953 that is provided in a first frame 2952 of the LCD (e.g., a 120 Hz frame), and a single backlight pulse 2955 that is provided in a second frame 2954 of the LCD (e.g., another 120 Hz frame). The single backlight pulse per 120 Hz frame, for example, helps to reduce motion blur of fast moving contents. In some implementations, the backlight pulses 2953 and 2955 are provided with an increased width relative to the width of backlight pulses 2914 and 2924. In some implementations, the transitions between the two backlight patterns (e.g., 2900, 2950) can be combined seamlessly onto one display (e.g., 110) of device 100.

Figure 30:
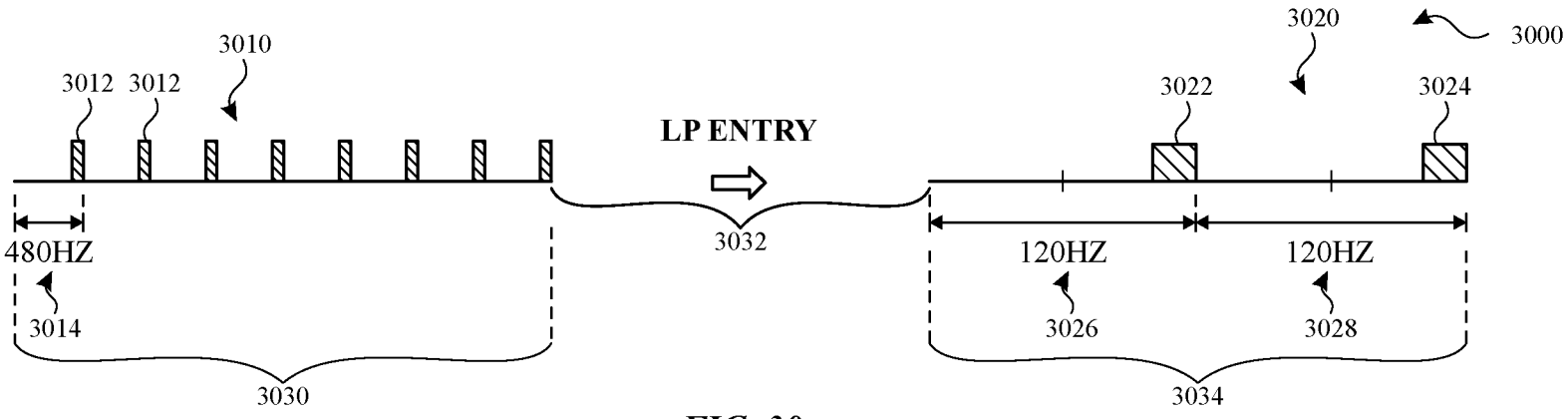
FIGS. 30 to 32 each show an example of a transition between operating the backlight with a first pulse pattern for a first LCD frame rate to a second pulse pattern for a second LCD frame rate in accordance with various aspects of the subject technology.
Figure 31:
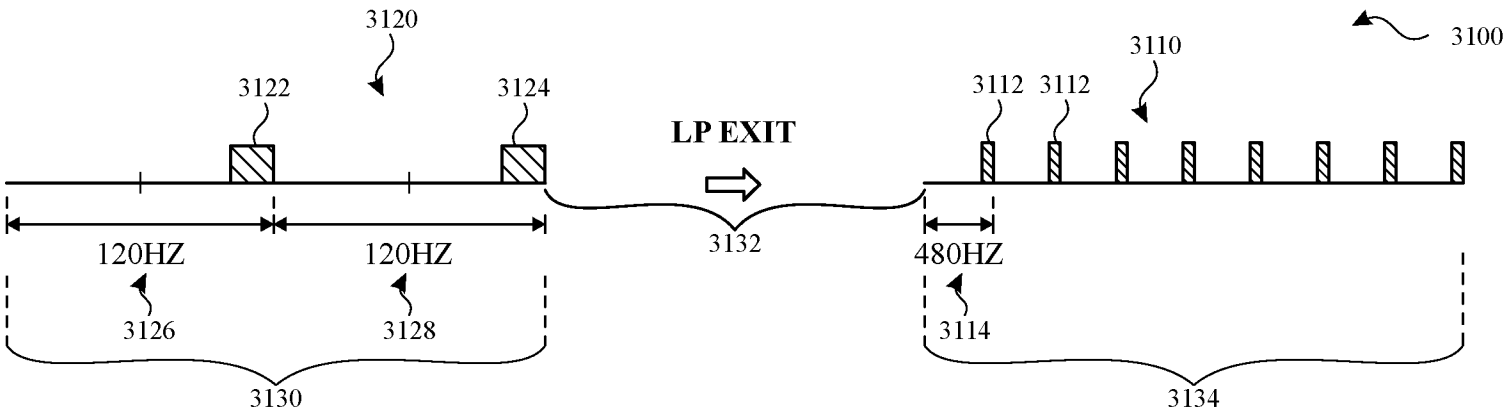
Figure 32:
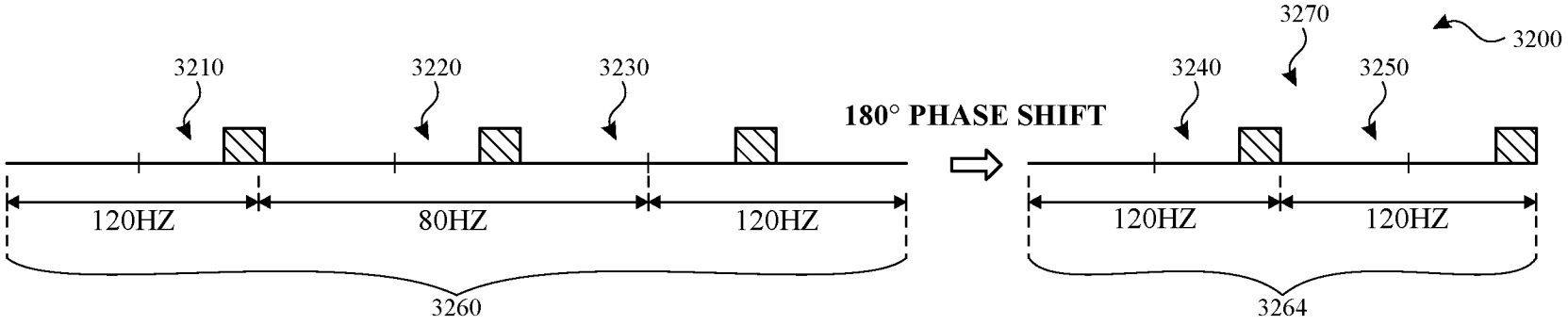

FIGS. 30 to 32 each show an example of a transition between operating the backlight with a first pulse pattern for a first LCD frame rate to a second pulse pattern for a second LCD frame rate. In order to transition between two steady states at different frame rates, a transition pattern can be applied between the two pulse patterns to bridge them for reduced flicker at a frame rate transition. In the example transition 3000 of FIG. 30, during a time period 3030, backlight unit 202, provides backlight pulses 3012 in a pulse pattern 3010 (e.g., with a frequency of 480 Hz per frame 3014). Following transition period 3032, BLU 202 begins providing the pulse pattern 3020 that includes backlight pulses 3022 and 3024 in separate respective frames 3026 and 3028 (e.g., with a frequency of 120 Hz per frame) during a time period 3034, each pulse having an individual pulse width that is larger than the pulse width of pulses 3012. In this respect, the transition 3000 depicts entry of a particular transition mode (e.g., low-persistence mode) to help reduce motion blur of fast moving contents. In some implementations, the transition period 3032 is less than 100 ms, but the duration of the transition period 3032 may vary depending on implementation. In this respect, the transition into the particular mode corresponding to the pulse pattern 3020 should occur within 100 ms. In some aspects, frames having a frame rate of about 120 Hz that are generated from e.g., CA compensation, PRC residue frames, etc., can be ignored.

Conversely, the example transition 3100 of FIG. 31 depicts a transition exit from the particular transition mode (e.g., low-persistence mode) of FIG. 30. For example, during a time period 3130, backlight unit 202 provides the pulse pattern 3120 that includes backlight pulses 3122 and 3124 in separate respective frames 3126 and 3128 (e.g., with a frequency of 120 Hz per frame). Following transition period 3132, BLU 202 begins providing backlight pulses 3112 in a pulse pattern 3110 (e.g., with a frequency of 480 Hz per frame 3114) during a time period 3134, each pulse having an individual pulse width that is smaller than the pulse width of pulses 3122 and 3124. In some implementations, the transition period 3132 is less than 100 ms, but the duration of the transition period 3032 may vary depending on implementation. In this respect, the transition exit from the particular mode corresponding to the pulse pattern 3120 should occur within 100 ms. In some aspects, the exit from the particular transition mode (e.g., from low-persistence mode to high-persistence mode) can be triggered when a predetermined number of frames have been dropped and/or a predetermined number of pulse patterns are detected as being repetitive. In some aspects, GPU dropped frames can be ignored (or skipped).

As depicted in FIG. 32, a phase shift (e.g., a 180-degree phase shift) in the LCD display frames can occur during a particular transition mode (e.g., low-persistence mode) as that shown in FIGS. 30 and 31. For example, while backlight unit 202 provides a low frequency (e.g., 120 Hz) pulse in a frame 3210, the GPU delays a frame 3220 for additional processing (e.g., at a frame rate of 80 Hz) such that a LCD frame phase shift has occurred. In this respect, the pulsing phase of frame 3230 is incorrect. In some implementations, a phase correction transition pulse pattern 3270 having phase correction pulses in frames 3240 and 3250 is provided during a time period 3264 for a frame phase correction, and backlight unit 202 operates the backlight LEDs with the obtained phase correction transition pulse pattern 3270. In some implementations, the length of the time period 3264 is less than 80 ms, but the duration of the time period 3264 may vary depending on implementation. In this respect, the duration to complete the phase correction in the frame phase correction mode should occur within 80 ms given that speed is critical to avoid strobing effects.

Figure 33:
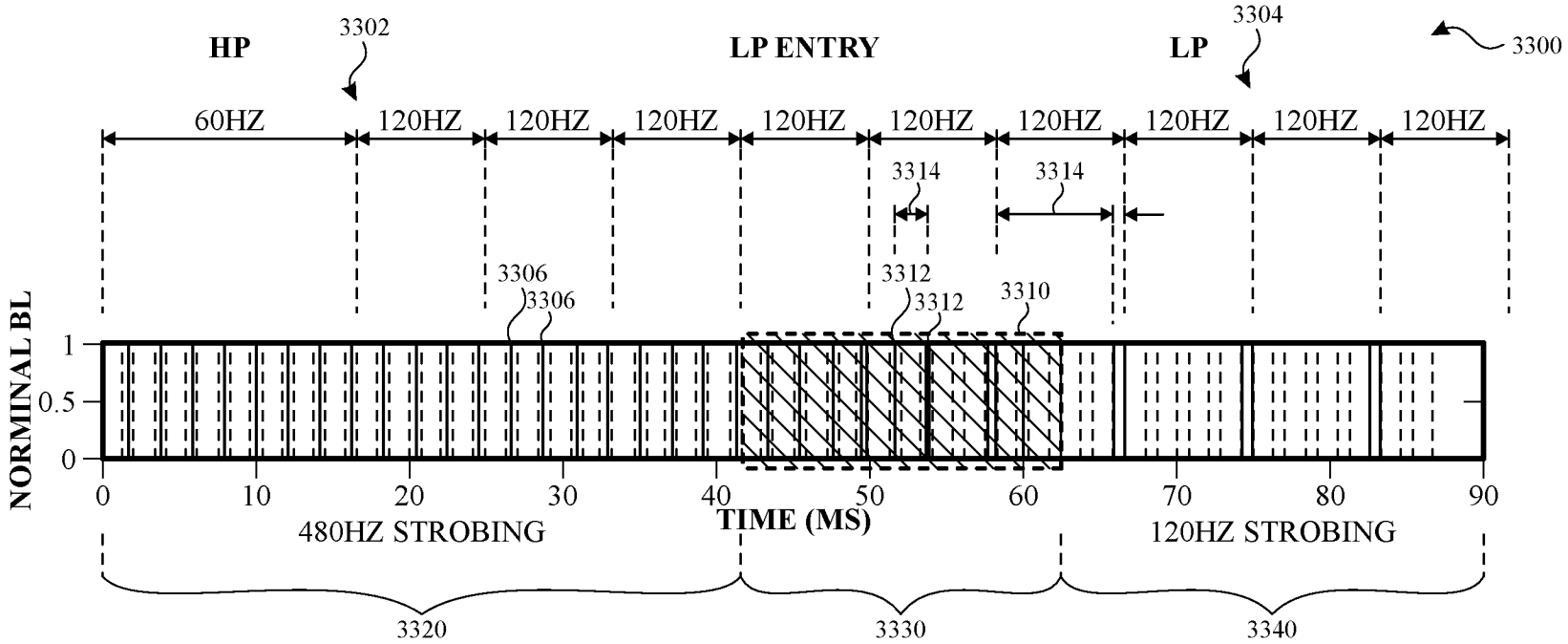
FIGS. 33 to 35 each show an example of a transition between operating the backlight with a first pulse pattern for a first LCD frame rate to a second pulse pattern for a second LCD frame rate in accordance with various aspects of the subject technology.
Figure 34:
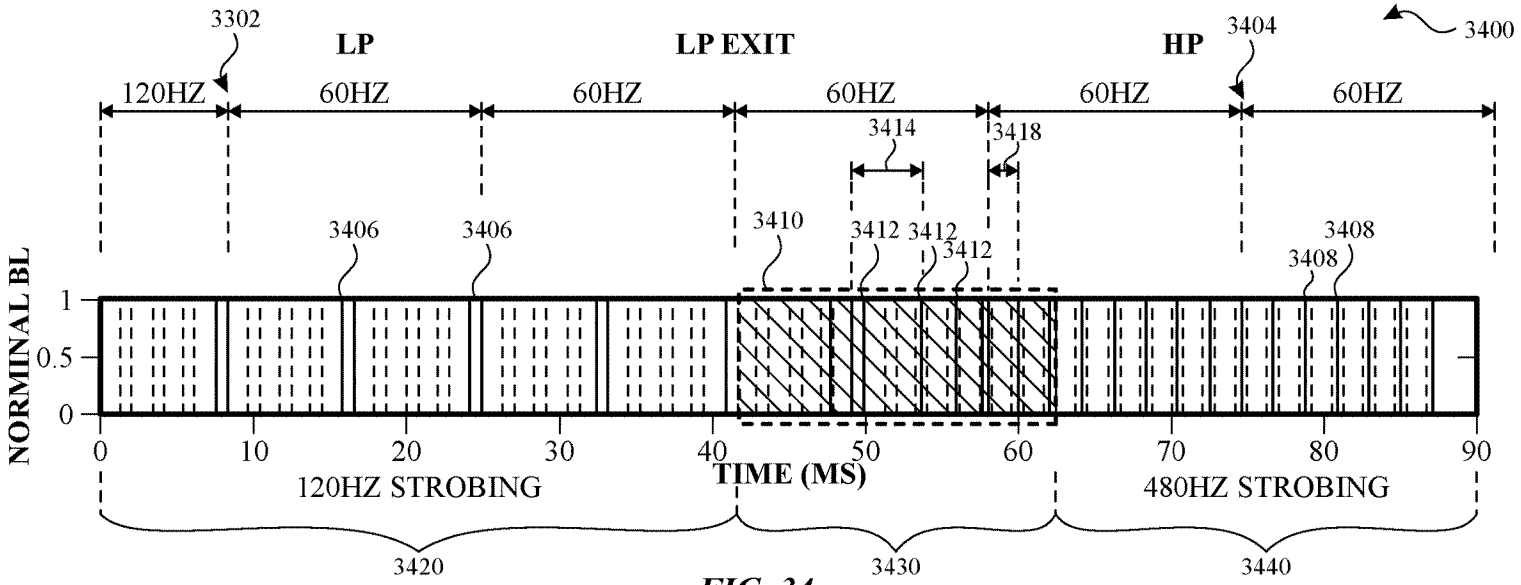
Figure 35:
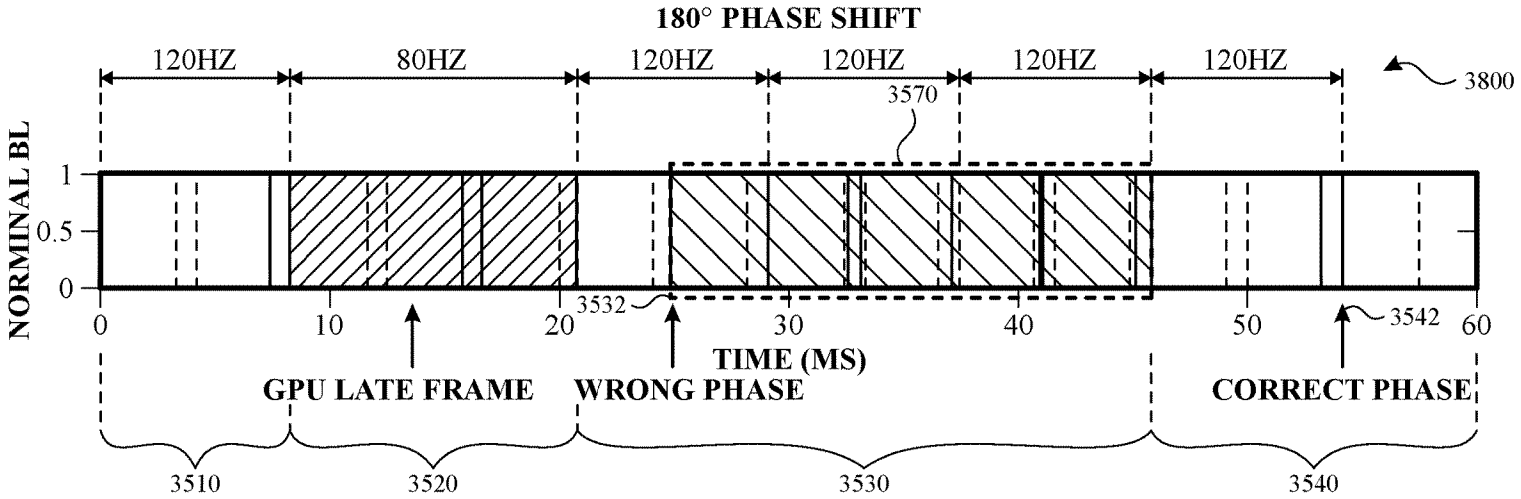

FIGS. 33 to 35 each show an example of a transition between operating the backlight with a first pulse pattern 3302 for a first LCD frame rate to a second pulse pattern 3304 for a second LCD frame rate. In the example transition 3300 of FIG. 33, during a time period 3320, backlight unit 202 provides backlight pulses in the pulse pattern 3302 (e.g., with a frequency of 480 Hz per frame). However, in order to avoid visible artifacts caused by the transition from the first backlight pulse pattern to the second backlight pulse pattern, BLU 202 may provide a transition pulse pattern 3310 that evolves during a transition time period 3330. In this respect, the transition pulse pattern 3310 depicts entry of a particular transition mode (e.g., low-persistence mode) to help reduce motion blur of fast moving contents. In some implementations, the transition time period 3310 is less than 100 ms. As depicted in FIG. 33, the duration of the transition time period 3310 is about 20 ms.

In the example of FIG. 33, transition pulse pattern 3310 include multiple pulses 3312. In each frame, each pulse is optimized to avoid flicker transitions such that the pulses have varying pulse widths. The narrow pulses in the transition pulse pattern 3310 become narrower over time such that they appear to vanish and the wider pulses remain to eventually form a single pulse per frame, thus corresponding to the second pulse pattern 3304 for the moving display content. In this way, the transition pulse pattern changes over time throughout the transition time period from a pulse pattern matching the first steady state pattern to a pulse pattern matching the second steady state pattern. Following the transition time period 3330, BLU 202 begins providing the pulse pattern 3004 that includes backlight pulses with a frame rate of 120 Hz per frame during a time period 3340, each pulse having an individual pulse width that is larger than the pulse width of pulses 3302.

Conversely, the example transition 3400 of FIG. 34 depicts a transition exit from the particular transition mode (e.g., to high-persistence mode) of FIG. 33. For example, during a time period 3420, backlight unit 202 provides the pulse pattern 3402 that includes backlight pulses 3406 in separate respective frames with a frame rate of 120 Hz per frame. However, in order to avoid visible artifacts caused by the transition from the first backlight pulse pattern 3402 to the second backlight pulse pattern 3404, BLU 202 may provide a transition pulse pattern 3410 that evolves during a transition time period 3430.

In the example of FIG. 34, transition pulse pattern 3410 include an increasing number of pulses 3412 over time, the pulses being separated by a decreasing separation time 3414. The decreasing separation time 3414 decreases until the pulses 3412 of transition pulse pattern 3410 are added over time and are distanced close enough to form multiple pulses per frame, thus corresponding to the second pulse pattern 3404 for static display content. In this way, the transition pulse pattern changes over time throughout the transition time period from a pulse pattern matching the first steady state pattern to a pulse pattern matching the second steady state pattern. Following transition period 3430, BLU 202 begins providing backlight pulses 3408 in a pulse pattern 3404 (e.g., with a frame rate of 60 Hz per frame) during a time period 3440, each pulse having an individual pulse width that is smaller than the pulse width of pulses 3406.

As depicted in FIG. 35, a phase shift (e.g., a 180-degree phase shift) in the LCD display frames can occur during a particular transition mode as that shown in FIGS. 33 and 34. For example, while backlight unit 202 provides a low frequency (e.g., 120 Hz) pulse in a frame 3510, the GPU delays a frame 3520 for additional processing (e.g., at a frame rate of 80 Hz) such that a LCD frame phase shift has occurred. In this respect, the pulsing phase of a frame starting at a time 3532 is incorrect. A phase correction transition pulse pattern 3570 having phase correction pulses is provided during a time period 3530 for a frame phase correction, and backlight unit 202 operates the backlight LEDs with the obtained phase correction transition pulse pattern 3570. Following the phase correction, the pulse pattern includes phase-corrected pulses. For example, the correct phase of a pulse can be detected at time 3542. As depicted in FIG. 35, the duration to complete the phase correction in the frame phase correction mode occurs within 20 ms.

Although the transition pulse patterns described in connection with FIGS. 33-35 are provided for a 480 Hz to 120 Hz frame rate transition, it should be appreciated that transition pulse patterns can also be provided for other decreasing frame rate transitions and/or for various increasing frame rate transitions.

Figure 36:
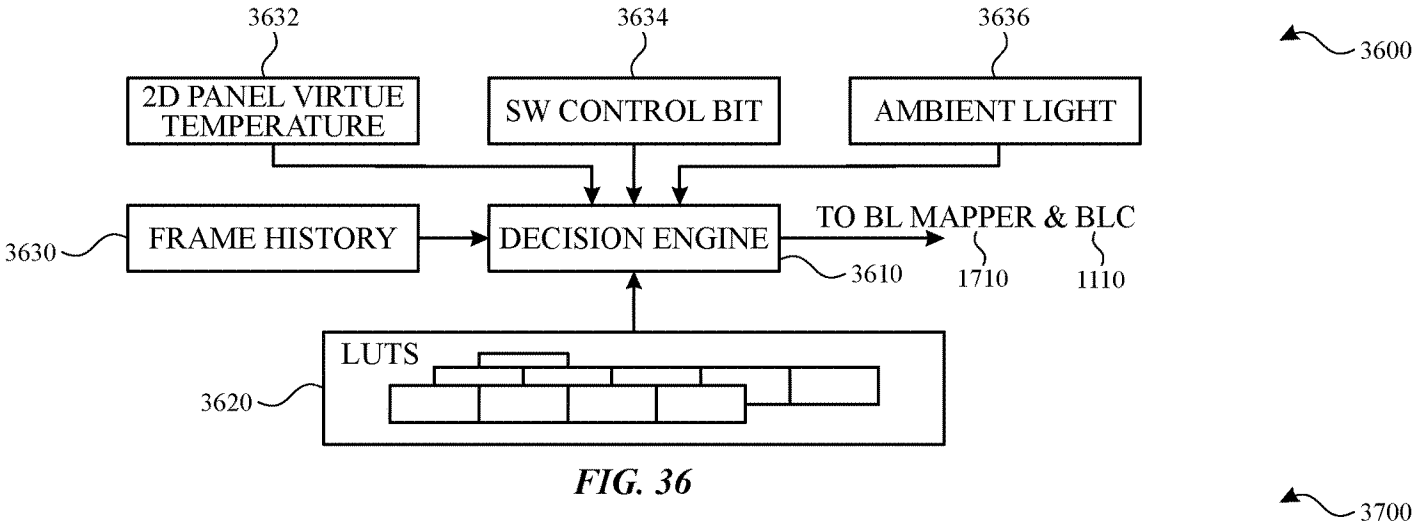
FIG. 36 shows an example of transition control circuitry including a decision engine for selecting transition pulse patterns for specific LCD frame rate transitions in accordance with various aspects of the subject technology.

FIG. 36 shows an example of transition control circuitry 3600 including a decision engine 3610 for selecting backlight pulse patterns for specific LCD frame rate transitions. As shown in FIG. 36, the transition control circuitry 3600 includes the decision engine 3610 and LOUT storage 3620. The decision engine 3602 may select a predetermined backlight pulse pattern from LUT storage 3620 when a corresponding LCD frame rate transition is identified. The backlight pulse patterns stored in LUT storage 3620 are predetermined to prevent visible artifacts on the display when a corresponding LCD frame rate change occurs (e.g., predetermined using the modeling techniques described herein). The decision engine 3602 may select one of the stored sequences using one or more input parameters, such as frame history 3630, two-dimensional (2D) panel virtue temperature conditions 3632, software (SW) control bit settings 3634, or ambient light conditions 3636. Signaling from the decision engine 3610 can be provided to the backlight mapper 1710 and/or the BLC 1110, depending on implementation.

Figure 37:
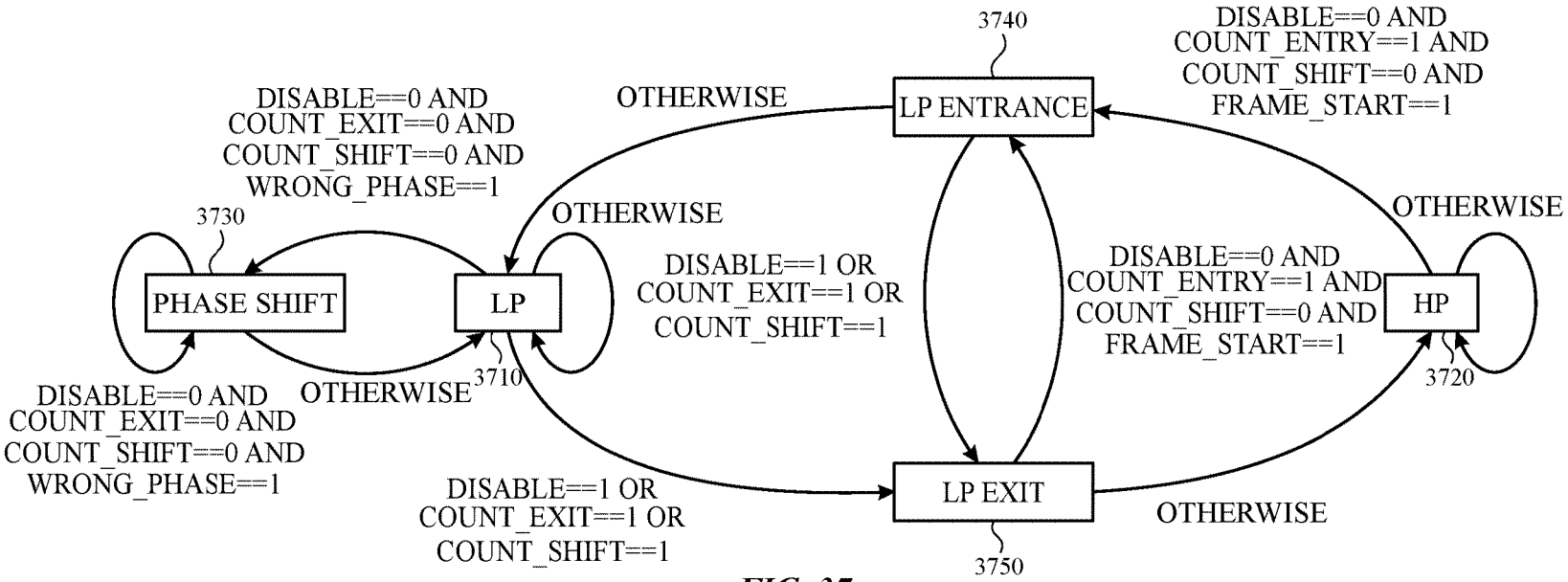
FIG. 37 conceptually illustrates an example of a state machine for the decision engine in accordance with one or more implementations of the subject technology.

FIG. 37 conceptually illustrates an example of a state machine 3700 for the decision engine 3610 in accordance with one or more implementations of the subject technology. The state machine 3700 includes a process with transitions between multiple transition modes of the BLU 202. The decision engine 3700 includes transition state 3710 (referred to as low-persistence mode or LP), transition state 3720 (referred to as high-persistence mode or HP), transition state 3730 (referred to as "Phase Shift Mode"), transition state 3740 (referred to as "LP Entrance Mode"), and transition state 3750 (referred to as "LP Exit Mode"). In some implementations, the transitions between states of the state machine 3700 occur using a disable signal ("Disable"), entry signal ("Count_entry"), exit signal ("Count_exit"), phase signal ("Wrong_phase"), shift signal ("Count_shift"), and frame start signal ("Frame_start").

TABLE 1

| State Machine Transitions | | |
|---|---|---|
| Signals | Configuration Parameters | Configuration Typ |
| Disable | N/A | N/A |
| Count_Entry | X | 4 |

TABLE 1-continued

| State Machine Transitions | | |
|---|---|---|
| Signals | Configuration Parameters | Configuration Typ |
| Count_Exit | Y1 | 4 |
| | Y2 | 10 |
| Wrong_Phase | N/A | N/A |
| Count_Shift | Z1 | 2 |
| | Z2 | 20 |
| Frame_Start | N/A | N/A |

The Disable signal is true (or logical 1) if the input bit from a processor to disable the LP Mode==1. The entry signal is true (or logical 1) if X continuous 120 Hz natural frames have been counted (and not due to PRC, CA or PDC frame repeats). In some aspects, X may be set to 4. In some aspects, the exit signal is true (or logical 1) if Y1 continuous frames with less than 120 Hz refresh rate in Y2 frames have been counted. In some aspects, Y1 may set to 4 and Y2 may be set to 10. A check is performed at the end of each frame during LP Mode, and the phase signal is true if a current frame has a frame rate of 120 Hz with a wrong phase. The shift signal is true (or logical 1) if a number of "phase shift" actions is greater than Z1 in Z2 subframes. In some aspects, Z1 is set to 2 and Z2 is set to 20. The frame start signal is true (or logical 1) if a new LC frame starts from a next backlight update.

The state machine 3700 includes a transition into the transition state 3740 and thereafter into the transition state 3710 from either the transition states 3720 or 3750 when the entry and frame start signals are true. The state machine 3700 includes a transition into the transition state 3750 and thereafter into the transition state 3720 from either the transition states 3710 or 3740 when either of the disable, exit or shift signals are true. The state machine 3700 includes a transition into the transition state 3730 when the phase signal is true and present in the transition state 3710.

Figure 38:
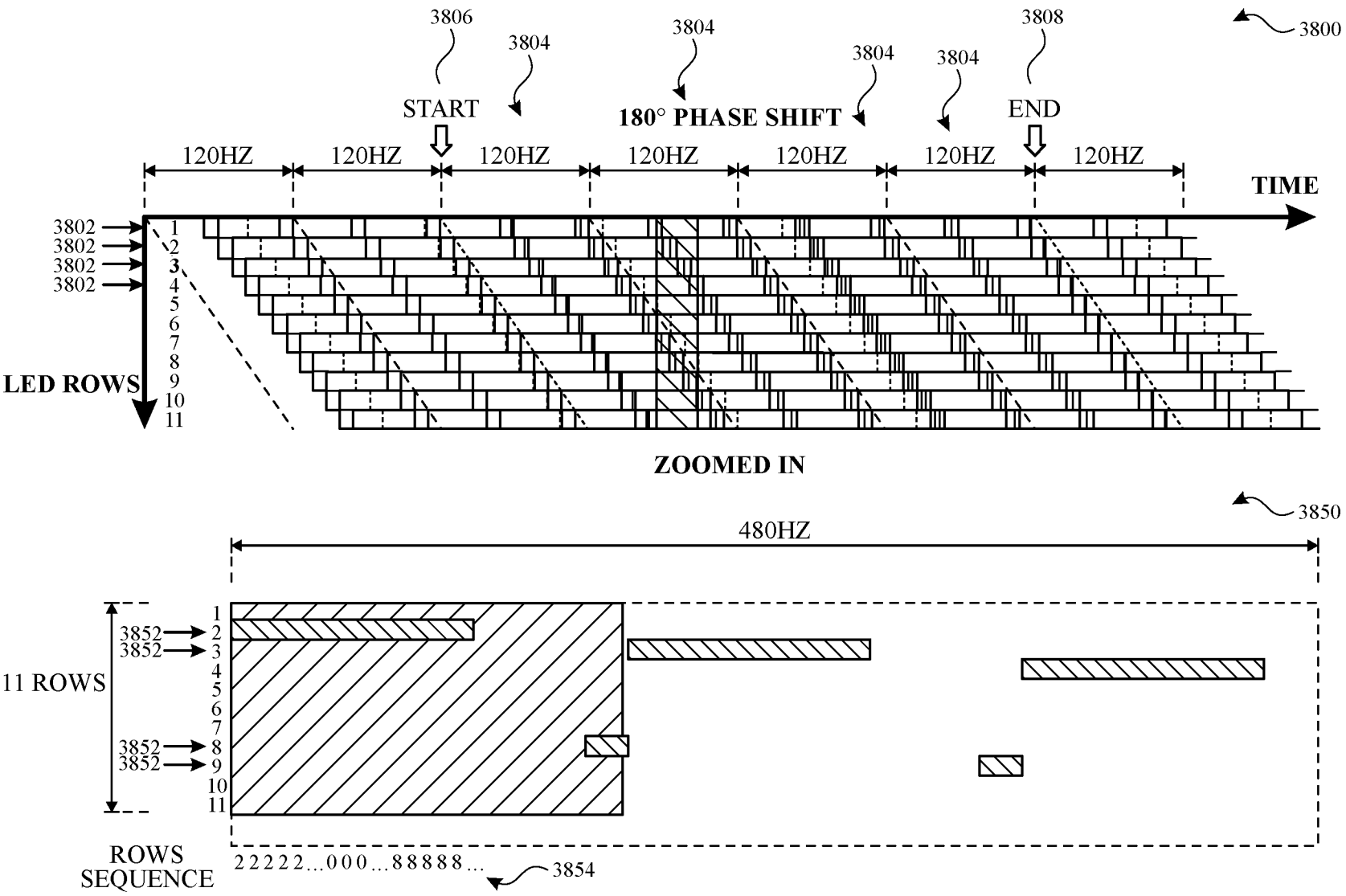
FIG. 38 shows a row-by-row application of a phase correction pulse transition operation as described in connection with FIGS. 32 and 35 in accordance with various aspects of the subject technology.

FIG. 38 shows a row-by-row application of a phase correction pulse transition operation 3800 as described in connection with FIGS. 32 and 35. As shown in FIG. 38, for each row 3802 of backlight LEDs and for each LCD display frame 3804, the phase correction transition pulse pattern may be applied at time 3806 (corresponds to start point) and may be completed at time 3808 (corresponds to end point). FIG. 38 also illustrates a zoomed-in representation 3850 of the phase correction pulse transition operation 3800 in a window of time. The zoomed-in representation 3850 depicts the phase correction pulse patterns being applied to individual rows 3852 on a non-overlapping basis according to a row sequence 3854. For example, each column driver prints 462 PWM pulses (referred to as "slots") in one 480 Hz update. With the row sequence 3854, each slot can be allocated to a specific row.

Figure 39:
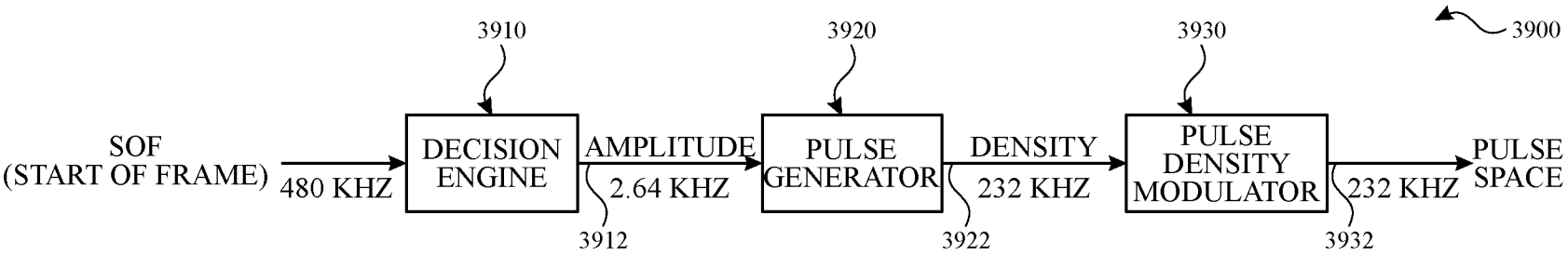
FIG. 39 shows an example of transition control circuitry in accordance with various aspects of the subject technology.

FIG. 39 shows an example of transition control circuitry 3900 including a decision engine 3910 for transition between high- and low-persistence modes, a pulse generator 3920 for up-sampling to a slot frequency, and a pulse density modulator 3930 for allocating a pulse space. In some aspects, the pulse density modulator 3930 can provide a 20 kHz pulse space that is compatible with the architectures discussed herein. In some implementations, the transition control circuitry 3900 replaces the LUT storage (e.g., 3620) in order to provide pulse transition patterns in real-time. The transition control circuitry 3900 does not require pre-recorded patterns, and instead generates patterns on-the-fly.

Having the real-time pulse patterns can be advantageous over LUT storage for a multitude of strobing phases and frequencies.

In some implementations, the decision engine 3910 is configured to decide the phase and amplitude of pulses associated with a particular pulse pattern (e.g., low-persistence mode). The pulse generator 3920 is configured to up-sample the signaling from the decision engine 3910 up to a slot frequency. In this respect, the pulse generator 3920 applies a pulse shape that corresponds to the low-persistence mode. The pulse density modulator 3930 is row sequence aware and is configured to allocate a pulse space with a pulse density as given by the pulse generator 3920.

Figure 40:
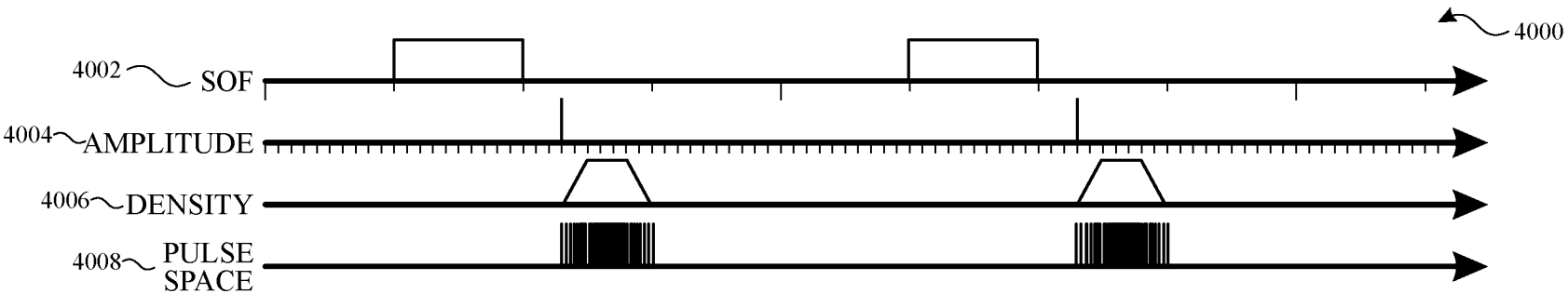
FIGS. 40 and 41 illustrate waveforms associated with the transition control circuitry in accordance with various aspects of the subject technology.
Figure 41:
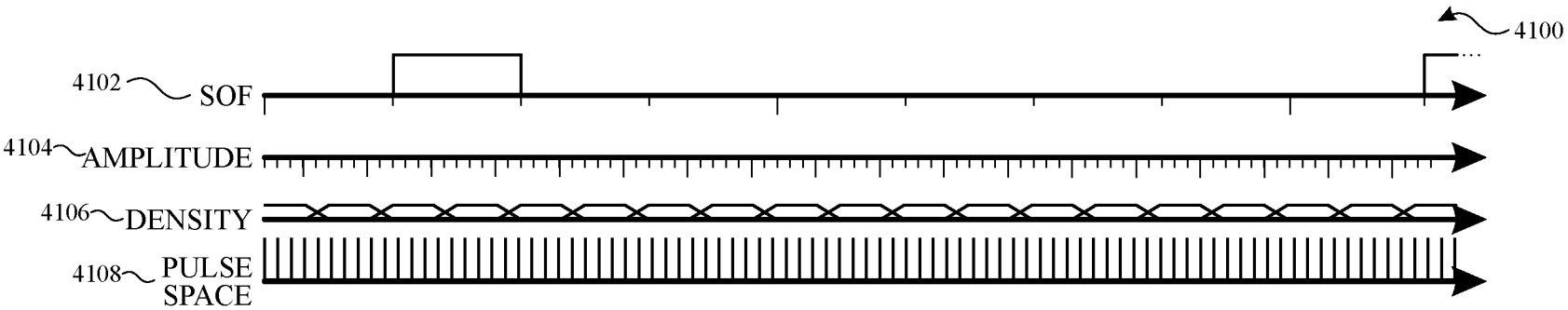

FIGS. 40 and 41 illustrate waveforms associated with the transition control circuitry 3900 In FIG. 40, a waveform 4000 depicts a SoF waveform 4002, an amplitude waveform 4004, a density waveform 4006 and a pulse space waveform 4008 for low-persistence timing. In FIG. 41, a waveform 4100 depicts a SoF waveform 4102, an amplitude waveform 4104, a density waveform 4106 and a pulse space waveform 4108 for high-persistence (HP) timing.

Referring back to FIG. 39, the decision engine 3910 receives frame history, such as the start of every frame (e.g., 4002, 4102) as input with a 480 kHz frequency. The decision engine 3910 feeds an amplitude signal 3912 (e.g., 4004, 4104) with an intermediate frequency to the pulse generator 3920, which in turn produces and feeds a density signal 3922 (e.g., 4006, 4106) to the pulse density modulator 3930 at the pulse space frequency. The pulse density modulator 3930 provides a pulse space signal 3932 (e.g., 4008, 4108) at the pulse space frequency. The pulse space signal represents the final pulse to display for the first row, where each subsequent row is a phase shifted copy of the first row.

Figure 42:
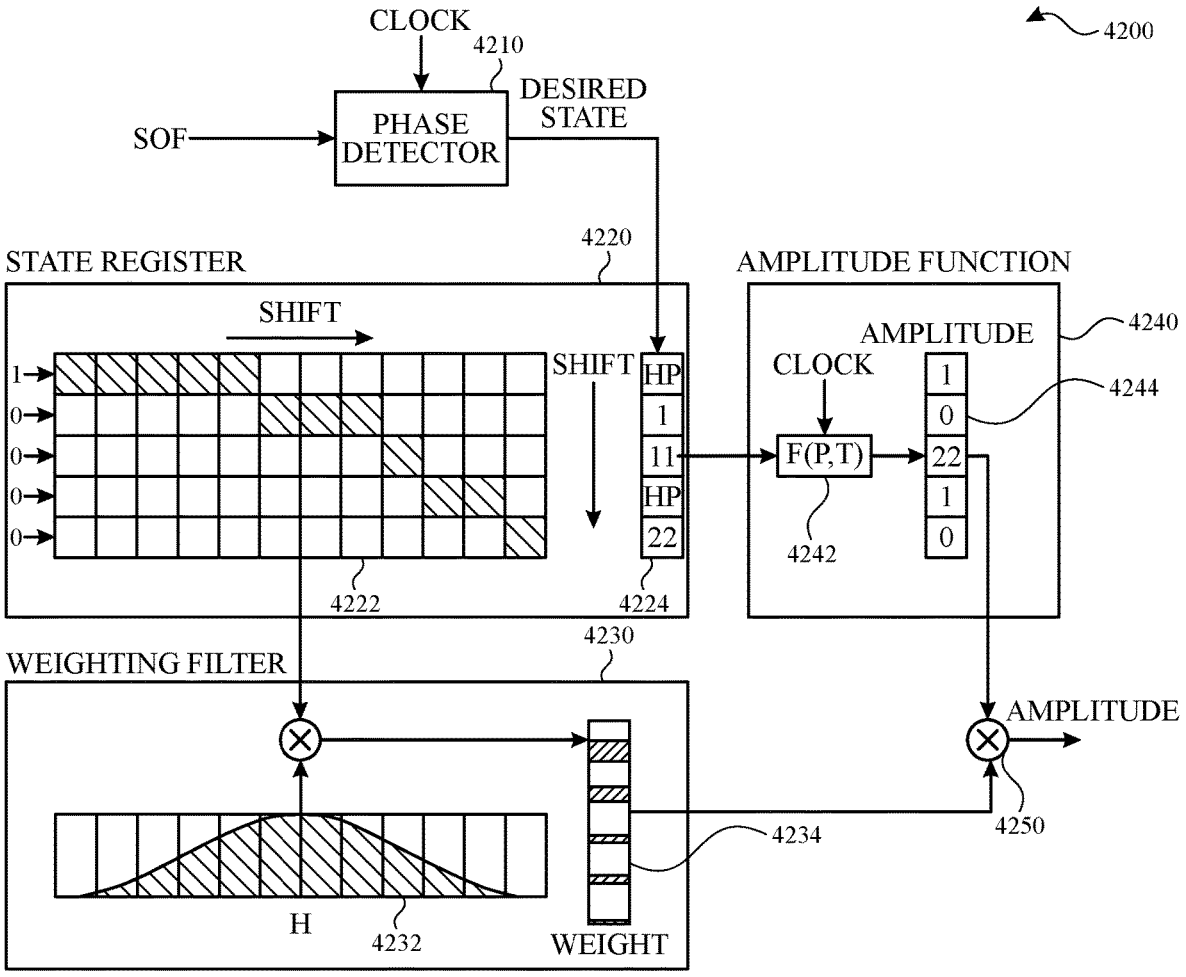
FIG. 42 illustrates a block diagram of an example of a decision engine circuitry in accordance with various aspects of the subject technology.

FIG. 42 illustrates a block diagram of an example of a decision engine circuitry 4200. The decision engine circuitry 4200 is, or includes, the decision engine 3910. The decision engine circuitry 4200 includes a phase detector 4210, a state register 4220, a weighting filter 4230, and an amplitude function 4240. The phase detector 4210 is configured to determine the desired state (e.g., LP mode with pulse phase or HP mode). The state register 4220 is configured to keep track of a state history. In some aspects, the state register 4220 includes a 2D shift register 4222. The 2D shift register 4222 performs a shift operation in a rightward direction at every clock transition (or tick), and another shift operation in a downward direction only on a state change. As a result, the 2D state organizes the desired state in a state history register 4224. The amplitude function 4240 is configured to calculate the current amplitude from a desired state and the current time using a function 4242. The calculated amplitude values are stored in an amplitude register 4244. The weighting filter 4230 is configured to apply a weight to every amplitude value. Each row in the 2D shift register 4222 is mixed with filter coefficients 4232 to produce weights for respective desired states. In some aspects, the amplitude application depends on a desired state history (e.g., 4224). In this regard, the weights are indexed according to the desired state history 4224 in a weighted register 4234. The value of the amplitude register 4244 are mixed with the values of the weighted register 4234 through mixer 4250 to produce the amplitude signal per clock tick.

Figure 43:
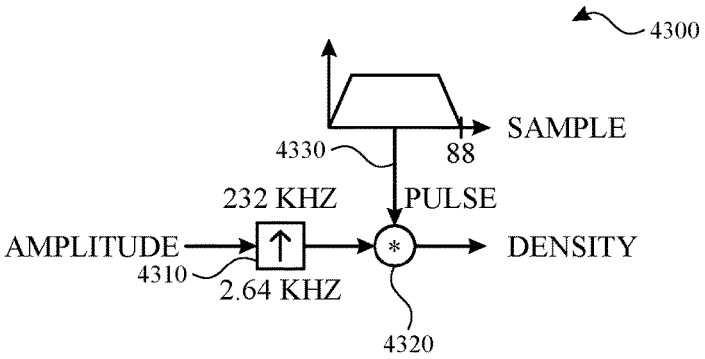
FIG. 43 illustrates a block diagram of an example of a pulse generator circuitry in accordance with various aspects of the subject technology.

FIG. 43 illustrates a block diagram of an example of a pulse generator circuitry 4300. The pulse generator circuitry 4300 is, or includes, the pulse generator 3920. The pulse generator circuitry 4300 includes an up-sample circuit 4310 and a convolution circuit 4320. The pulse generator circuit 4300 is configured to up-sample to the slot frequency. The pulse generator circuit 4300 receives a pulse shape signal 4330 and up-samples the signal from an intermediate frequency to a slot frequency of 232 kHz. The pulse generator circuit 4300 applies a given amplitude by intermixing the pulse shape signal 4330 to the up-sampled amplitude signal 4310 with the convolution circuit 4320 to produce the density signal (e.g., 3922). The amplitude signal is, or includes, the amplitude 3912. In some aspects, the pulse shape signal 4330 is stored in a look-up table.

Figure 44:
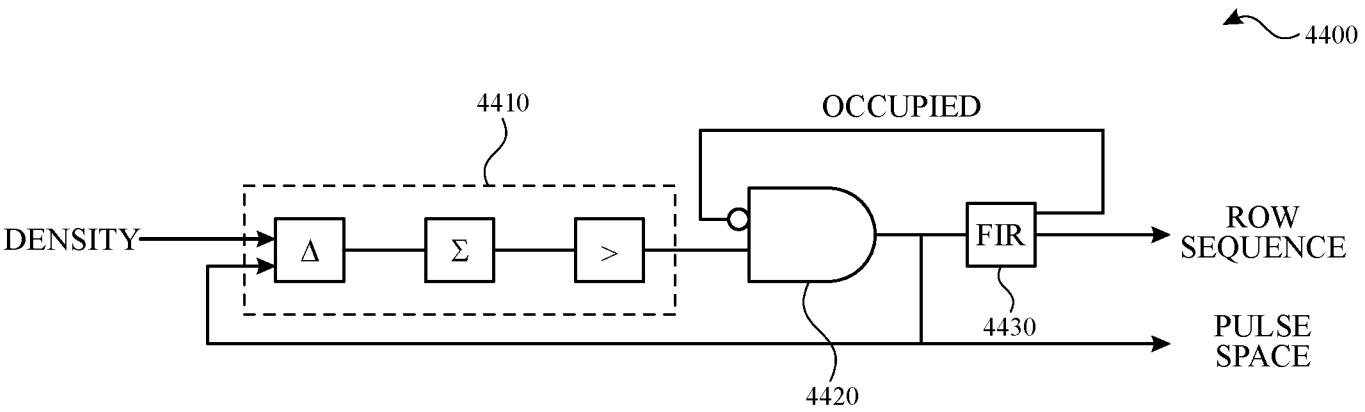
FIG. 44 illustrates a block diagram of an example of a pulse density modulation circuitry in accordance with various aspects of the subject technology.

FIG. 44 illustrates a block diagram of an example of a pulse density modulation circuitry 4400. The pulse density modulation circuitry 4400 is, or includes, the pulse density modulator 3930. The pulse density modulation circuitry 4400 includes a delta-sigma modulator 4410, a logical circuit 4420, and a digital filter 4430. The density signal (e.g., 3922) fed from the pulse generator 3920 is processed through the delta-sigma modulator 4410 and thereafter fed to the logical circuit 4420. In some implementations, the logical circuit 4420 includes a logical AND gate with an inverted input to the digital filter feedback path. The logical circuit 4420 produces a binary signal that represents the pulse space for the first row. The digital filter 4430 produces a first output signal that represents the row sequence (e.g., 3854) and a second output signal that represents whether a current slot is occupied by another row. In some aspects, the digital filter 4430 is a FIR filter, but can be implemented with any other type of filter depending on implementation. If a current slot is occupied by another row, then the pulse space is false (or logical 0). In some aspects, the delta-sigma modulator 4410 is configured to place a pulse in a next time slot, if available.

Figure 45:
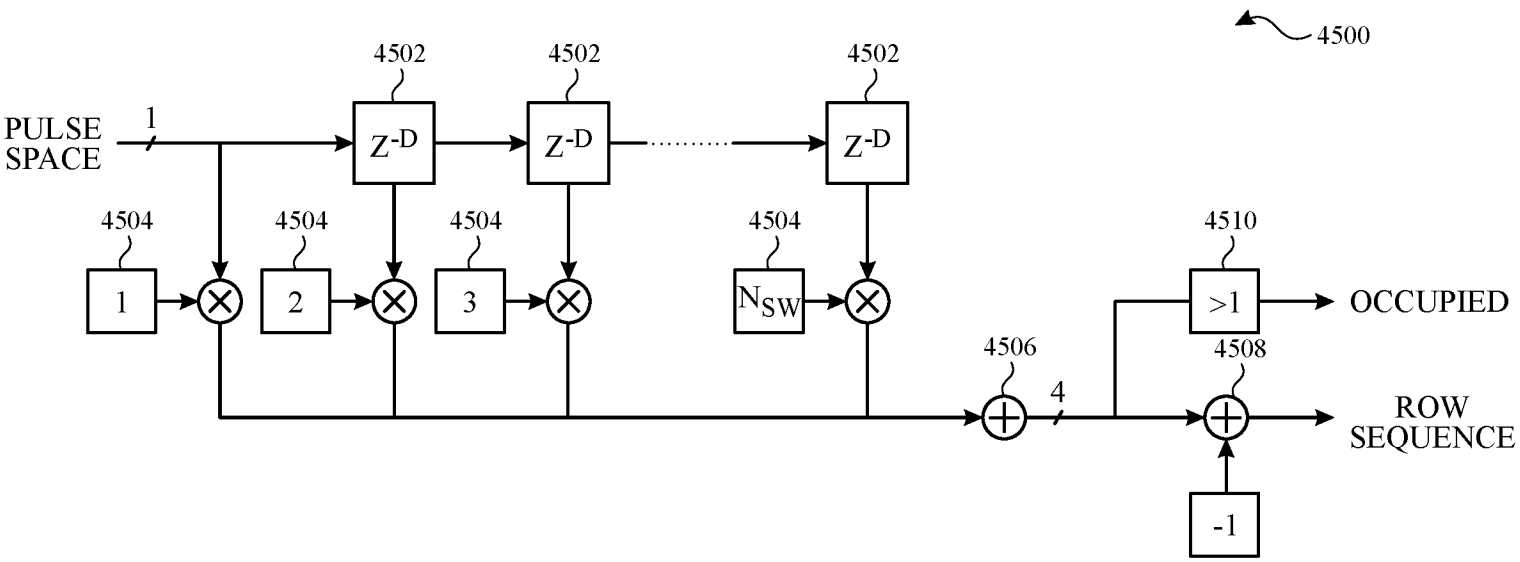
FIG. 45 illustrates a block diagram of an example of a row sequence generator circuitry in accordance with various aspects of the subject technology.

FIG. 45 illustrates a block diagram of an example of a row sequence generator circuitry 4500. The row sequence generator circuitry 4500 is, or includes, the digital filter 4430, where the row sequence generator can be implemented as a FIR filter. The row sequence generator circuitry 4500 includes phase shifting function blocks 4502, table values 4504, adders 4506 and 4508, and a comparator 4510. The row sequence generator 4500 receives the pulse space signal from the logical circuit 4420 to produce the occupied signal and the row sequence signal.

In some aspects, each of the phase shifting function blocks 4502 is combined with a respective one of the table values 4504 through a corresponding adder to produce a respective phase shifted pulse. In this respect, the row sequence generator circuitry 4500 includes a shift register length of $N_{SW}*D_{ROW}$, where $N_{SW}$ is the number of row driver (RD) output switches enabled and $D_{ROW}$ is the delay between RD rows, in terms of slots. In some aspects, the RD rows are indexed from 0 to $N_{RDROWS-1}$, where a RD non-row index is represented by 0×F. Each of the phase shifting function blocks 4502 provides a shift by a tap distance (d) equal to $D_{ROW}$. The table values are in a range of 1 to $N_{SW}$. The phase shifted pulses are aggregated together through the adder 4506 to produce a resulting pulse and fed to different signal paths. On the row sequence signal path, the resulting pulse is subtracted by 1 through the adder 4508 to produce the row sequence signal. On the occupied signal path, the resulting pulse is compared to a fixed value at comparator 4510 to produce the occupied signal. In some aspects, for a dummy row, the tap value equals 0 and can be ignored in the row sequence generator circuitry 4500.

The various individual pulse patterns, transition pulse patterns, FIR filtering, and decision engine operations described herein can be applied alone or in any desired combination such that visible strobing effects at low frequencies, motion blur at high frequencies, and/or flicker due to frequency changes and frame rate transitions are reduced or eliminated. Although the examples described herein often refer to specific refresh rates and transitions therebetween (e.g., 60 Hz, 80Hz, 120 Hz, and 240 Hz), it should be appreciated that a display may be operated with an arbitrary number of refresh rates and that the systems and methods described herein can be applied to mitigate undesirable effects from backlight pulsing for any of the arbitrary number of refresh rates.

In accordance with various aspects of the subject disclosure, a method of operating an electronic device having a display with a backlight unit and a liquid crystal display (LCD) unit is provided, the method including displaying first display content with the LCD unit at a first LCD frame rate. The method also includes, while providing the first display content at the first LCD frame rate, providing backlight pulses with a first backlight pulse pattern within each LCD frame. The method also includes displaying second display content with the LCD unit at a second LCD frame rate. The method also includes, while providing the second display content at the second LCD frame rate, providing backlight pulses with a second backlight pulse pattern within each LCD frame. The first backlight pulse pattern and the second backlight pulse pattern are each arranged to prevent flicker on the display related to the change from the first backlight pulse pattern to the second backlight pulse pattern.

In accordance with various aspects of the subject disclosure, a method of operating an electronic device having a display with a backlight unit and a liquid crystal display (LCD) unit is provided, the method including, displaying first display content with an LCD unit at a first LCD frame rate. The method also includes, while providing the first display content at the first LCD frame rate, providing backlight pulses with a first backlight pulse pattern. The method also includes displaying second display content with the LCD unit at a second LCD frame rate. The method also includes, while providing the second display content at the second LCD frame rate, providing backlight pulses with a second backlight pulse pattern. The method also includes providing backlight pulses with a transition pulse pattern between providing the backlight pulses with the first backlight pulse pattern and the second backlight pulse pattern.

In accordance with various aspects of the subject disclosure, a method of operating an electronic device having a display with a backlight unit and a liquid crystal display (LCD) unit is provided, the method including, displaying first display content with an LCD unit at a first LCD frame rate. The method also includes, while providing the first display content at the first LCD frame rate, providing backlight pulses with a first backlight pulse pattern. The method also includes displaying second display content with the LCD unit at a second. LCD frame rate. The method also includes, while providing the second display content at the second LCD frame rate, providing backlight pulses with a second backlight pulse pattern. The method also includes splitting at least a first pulse of the second backlight pulse pattern between at least one pulse of the first backlight pulse pattern and at least one other pulse of the second backlight pulse pattern.

In accordance with various aspects of the subject disclosure, a method of operating an electronic device having a display with a backlight unit and a liquid crystal display (LCD) unit is provided, the method including, operating the liquid crystal display unit with a variable frame rate. The method also includes, while operating the liquid crystal display unit with the variable frame rate, providing backlight pulses with the backlight unit at a first pulse rate. The method also includes, with a decision engine for the display, determining whether one or more frequency transition conditions have been met. The method also includes, with the decision engine, obtaining a transition pulse pattern that is specific to a frame rate transition for the LCD unit if the one or more frequency transition conditions have been met. The method also includes, with the backlight unit, providing backlight pukes according to the obtained transition pulse pattern. The method also includes, with the backlight unit, providing backlight pulses with a second pulse rate after providing the backlight pulses according to the obtained transition pulse pattern.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD−RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-pans of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A method of operating an electronic device having a display with a backlight unit and a liquid crystal display (LCD) unit, the method comprising:

displaying first display content with the LCD unit at a first LCD frame rate;

while providing the first display content at the first LCD frame rate, providing backlight pulses with a first backlight pulse pattern;

displaying second display content with the LCD unit at a second LCD frame rate;

while providing the second display content at the second LCD frame rate, providing backlight pulses with a second backlight pulse pattern;

splitting at least a first pulse of the second backlight pulse pattern between at least one pulse of the first backlight pulse pattern and at least one other pulse of the second backlight pulse pattern; and wherein splitting at least the first pulse of the second backlight pulse pattern comprises preventing execution of the first pulse of the second backlight pulse pattern and adding equal portions of the first pulse of the second backlight pulse pattern to each of an immediately preceding pulse and an immediately following pulse.

2. The method of claim 1, further comprising operating a digital filter to cause the equal splitting.

3. The method of claim 1, wherein splitting at least the first pulse of the second backlight pulse pattern comprises splitting the first pulse of the second backlight pulse pattern and at least one of another pulse of the second backlight pulse pattern or a pulse of the first backlight pulse pattern.

4. The method of claim 3 further comprising operating a digital filter to cause the first backlight pulse pattern.

5. The method of claim 3 further comprising operating a digital filter to cause the second backlight pulse pattern.

6. A electronic device with a display, the display comprising:

a backlight unit;

a liquid crystal display (LCD) unit configured to display first display content a first LCD frame rate, a controller configured to cause the backlight unit to pulse a first backlight pulse pattern while the LCD unit provides the first display content at the first LCD frame rate;

the LCD unit further configured to display second display content at a second LCD frame rate;

the controller is further configured to cause the backlight unit to pulse a second backlight pulse pattern while the LCD unit provides the second display content at the second LCD frame rate;

the controller is further configured to split at least a first pulse of the second backlight pulse pattern between at least one pulse of the first backlight pulse pattern and at least one other pulse of the second backlight pulse pattern; and wherein splitting at least the first pulse of the second backlight pulse pattern comprises preventing execution of the first pulse of the second backlight pulse pattern and adding equal portions of the first pulse of the second backlight pulse pattern to each of an immediately preceding pulse and an immediately following pulse.

7. The electronic device of claim 6, further comprising operating a digital filter to cause the equal splitting.

8. The electronic device of claim 6, wherein splitting at least the first pulse of the second backlight pulse pattern comprises splitting the first pulse of the second backlight pulse pattern and at least one of another pulse of the second backlight pulse pattern or a pulse of the first backlight pulse pattern.

9. The electronic device of claim 8 further comprising:

a digital filter configured to cause the first backlight pulse pattern.

10. The electronic device of claim 8 further comprising:

a digital filter configured to cause the second backlight pulse pattern.

11. A non-transitory computer-readable storage medium encoded with data and instructions, when executed by an electronic device having a display with a backlight unit and a liquid crystal display (LCD) unit, further causing the electronic device to:

display first display content with the LCD unit at a first LCD frame rate;

while providing the first display content at the first LCD frame rate, provide backlight pulses with a first backlight pulse pattern;

display second display content with the LCD unit at a second LCD frame rate;

while providing the second display content at the second LCD frame rate, provide backlight pulses with a second backlight pulse pattern;

split at least a first pulse of the second backlight pulse pattern between at least one pulse of the first backlight pulse pattern and at least one other pulse of the second backlight pulse pattern; and wherein the splitting at least the first pulse of the second backlight pulse pattern comprises preventing execution of the first pulse of the second backlight pulse pattern and adding equal portions of the first pulse of the second backlight pulse pattern to each of an immediately preceding pulse and an immediately following pulse.

12. The non-transitory computer-readable storage medium of claim 11, further causing the electronic device to:

operate a digital filter to cause the equal splitting.

13. The non-transitory computer-readable storage medium of claim 11, wherein the splitting at least the first pulse of the second backlight pulse pattern comprises splitting the first pulse of the second backlight pulse pattern and at least one of another pulse of the second backlight pulse pattern or a pulse of the first backlight pulse pattern.

14. The non-transitory computer-readable storage medium of claim 13 further comprising operating a digital filter to cause the first backlight pulse pattern.

15. The non-transitory computer-readable storage medium of claim 13 further comprising operating a digital filter to cause the second backlight pulse pattern.

* * * * *